US005357069A

United States Patent [19]

Nishio et al.

[11] Patent Number: 5,357,069

[45] Date of Patent: Oct. 18, 1994

[54] STRUCTURE OF SLIDING SWITCH CONTACTS

[75] Inventors: Minoru Nishio; Shigeo Hara, both of Niwa; Masaru Suzuki, Chiryu; Kazuhisa Kubota, Niwa, all of Japan

[73] Assignee: Kabushiki Kaisha Tokai-Rika-Denki-Seisakusho, Tokyo, Japan

[21] Appl. No.: 970,461

[22] Filed: Nov. 2, 1992

[30] Foreign Application Priority Data

Nov. 6, 1991 [JP] Japan ..... 3-099366[U]
Jan. 24, 1992 [JP] Japan ..... 4-002110[U]

[51] Int. Cl.[5] ..... H01H 1/36

[52] U.S. Cl. ..... 200/252; 200/275; 200/5 R; 200/550

[58] Field of Search ..... 200/547, 548, 549, 550, 200/252, 258, 275, 292, 5 R, 16 A, 16 D

[56] References Cited

U.S. PATENT DOCUMENTS 2,837,609 6/1958 Clayton et al. ..... 200/550
4,012,608 3/1977 Lockard ..... 200/550
4,057,520 11/1977 Schwartz ..... 200/550 X
4,316,067 2/1982 Whiteman ..... 299/292 X
5,049,707 9/1991 Kameya ..... 200/160

*Primary Examiner*—Glenn T. Barnett
*Attorney, Agent, or Firm*—Oliff & Berridge

[57] ABSTRACT

A sliding switch having a tandem-type contact structure in which a first and a second insulation portion are disposed in a first and a second negative fixed contact, respectively, of a first and a second group of fixed contacts. When a first and a second movable contact slide between a neutral position and a first operating position, an arc is produced between the first movable contact and the first negative fixed contact in which the first insulation portion is disposed. When the first and the second movable contact slide between the neutral position and a second operating position, an arc is produced between the second movable contact and the second negative fixed contact in which the second insulation portion is disposed. A decline in the insulation performance between the fixed contacts of different polarities is prevented.

32 Claims, 40 Drawing Sheets

STRUCTURE OF SLIDING SWITCH CONTACTS

BACKGROUND OF THE INVENTION

1. Field of the Invention

The present invention relates to the structure of contacts of a so-called tandem sliding switch having a first and a second movable contact which respectively slide on a first and a second group of fixed contacts.

2. Description of the Related Art

A conventional arrangement of the structure of contacts of a sliding switch of this type is shown in FIGS. 40 and 41. This switch is used for, for instance, a window regulator for vertically moving the window glass of an automobile.

In FIG. 40, a first group 2 of fixed contacts and a second group 3 of fixed contacts are arranged in parallel on a substrate 1.

The first group 2 of fixed contacts comprises a first common fixed contact 2*a* connected to a reversible motor 4, a first positive fixed contact 2*b* connected to a positive terminal of a power source, and a first negative fixed contact 2*c* connected to a negative terminal of the power source via a ground connection.

Meanwhile, in the same way as the first group 2 of fixed contacts, the second group 3 of fixed contacts comprises a second common fixed contact 3*a* connected to the motor 4, a second positive fixed contact 3*b* connected to the positive terminal of the power source, and a second negative fixed contact 3*c* connected to the negative terminal of the power source via a ground connection.

A first movable contact 5 which slides on the first group 2 of fixed contacts and a second movable contact 6 which slides on the second group 3 of fixed contacts are mounted on an unillustrated contact holder. These first and second movable contacts 5, 6 are adapted to slidingly move simultaneously in the direction of arrow A in FIG. 40 and in an opposite direction thereto.

In this arrangement, in a state in which the first and second movable contacts 5, 6 are located at a neutral position indicated by two-dotted dash lines in FIG. 40, contact portions 5*a*, 5*b* of the first movable contact 5 are respectively in contact with the first common fixed contact 2*a* and the first negative fixed contact 2*c*, while contact portions 6*a*, 6*b* of the second movable contact 6 are respectively in contact with the second common fixed contact 3*a* and the second negative fixed contact 3*c*. In this state, the motor 4 is in a deenergized state and is in a neutral state.

When, upon operation of the switch, the first and second movable contacts 5, 6 slide in the direction of arrow A from the aforementioned neutral position and reach the first operating position (see the dotted dash lines in FIG. 41), the contact portions 5*a*, 5*b* of the first movable contact 5 respectively remain in contact with the first common fixed contact 2*a* and the first negative fixed contact 2*c*, but the contact portions 6*a*, 6*b* of the second movable contact 6 are changed over to a state in which they are brought into contact with the second common fixed contact 3*a* and the second positive fixed contact 3*b*.

In this state, electric current flows across the motor 4 in the direction of arrow B in FIG. 41, and the motor 4 is thereby rotated forwardly, which in turn causes the window glass to be raised and set in a raised state.

On the other hand, when, upon operation of the switch, the first and second movable contacts 5, 6 slide in the opposite direction to that of arrow A from the neutral position in FIG. 40 and reach the second operating position (see the broken lines in FIG. 41), the contact portions 6*a*, 6*b* of the second movable contact 6 respectively remain in contact with the second common fixed contact 3*a* and the second negative fixed contact 3*c*, but the contact portions 5*a*, 5*b* of the first movable contact 5 are changed over to a state in which they are brought into contact with the first common fixed contact 2*a* and the first positive fixed contact 2*b*.

In this state, electric current flows across the motor 4 in the opposite direction that of arrow B, and the motor 4 is thereby rotated reversely, which in turn causes the window glass to be lowered and set in a lowered state.

It should be noted that if the switch operation is canceled, the first and second movable contacts 5, 6 are automatically reset to the neutral position.

In the switch having the above-described arrangement, when the first and second movable contacts 5, 6 slide between the neutral position and the first operating position (during a changeover between the neutral state and the raised state), an arc occurs solely between the contact portion 6*a* of the second movable contact 6 and the second positive fixed contact 3*b*. On the other hand, when the first and second movable contacts 5, 6 slide between the neutral position and the second operating position (during a changeover between the neutral state and the lowered state), an arc occurs solely between the contact portion 5*a* of the first movable contact 5 and the first positive fixed contact 2*b*.

For this reason, there has been a drawback in that, owing to metal powders produced by arcs, the insulation performance declines in an insulation space portion 7 between the second positive fixed contact 3*b* and the second common fixed contact 3*a* and in an insulation space portion 8 between the first positive fixed contact 2*b* and the first common fixed contact 2*a*. In other words, the insulation performance declines between fixed contacts of different polarities, respectively.

SUMMARY OF THE INVENTION

Accordingly, it is a primary object of the present invention to provide the structure of contacts of a tandem sliding switch which is capable of preventing a decline in the insulation performance between contacts of different polarities.

To this end, in accordance with a first aspect of the present invention, there is provided a sliding switch including: a first group of fixed contacts having a first common fixed contact, a first positive fixed contact, and a first negative fixed contact; a second group of fixed contacts having a second common fixed contact connected to the first common fixed contact via a load, a second positive fixed contact, and a second negative fixed contact; a first movable contact disposed so as to slide between a first operating position and a second operating position with a neutral position placed therebetween and to slide on the first group of fixed contacts as the first movable contact slides, the first movable contact being adapted to contact the first common fixed contact and one of the first positive and negative fixed contacts in the neutral position and the first operating position and to contact the first common fixed contact and the other one of the first positive and negative fixed contacts in the second operating position; and a second movable contact disposed so as to slide between the first operating position and the second operating position with the neutral position placed therebetween in synchronism with the first movable contact and to slide on the second group of fixed contacts as the second movable contact slides, the second movable contact being adapted to contact the second common fixed contact and one of the second positive and negative fixed contacts in the neutral position and the second operating position and to contact the second common fixed contact and the other one of the second positive and negative fixed contacts in the first operating position, the sliding switch comprising:

a first insulation portion disposed in one of the first positive and negative fixed contacts so as to temporarily move the first movable contact away from one of the first positive and negative fixed contacts before the second movable contact moves away from one of the fixed contacts of the second group of fixed contacts when the first and second movable contacts slide from the first operating position to the neutral position; and a second insulation portion disposed in one of the second positive and negative fixed contacts so as to temporarily move the second movable contact away from one of the second positive and negative fixed contacts before the first movable contact moves away from one of the fixed contacts of the first group of fixed contacts when the first and second movable contacts slide from the second operating position to the neutral position.

In the first aspect of the invention, the sliding switch including the first and second groups of fixed contacts and the first and second movable contacts, which are arranged as described above, may be provided with:

a first insulation portion disposed in one of the first positive and negative fixed contacts so as to temporarily move the first movable contact away from one of the first positive and negative fixed contacts after the first movable contact has contacted one of the positive and negative fixed contacts of the first group of fixed contacts and so as to cause the first movable contact to contact again one of the first positive and negative fixed contacts after the second movable contact has contacted one of the second positive and negative fixed contacts, when the first and second movable contacts slide from the neutral position to the first operating position; and a second insulation portion disposed in one of the second positive and negative fixed contacts so as to temporarily move the second movable contact away from one of the second positive and negative fixed contacts after the second movable contact has contacted one of the positive and negative fixed contacts of the second group of fixed contacts and so as to cause the second movable contact to contact again one of the first positive and negative fixed contacts after the first movable contact has contacted one of the first positive and negative fixed contacts, when the first and second movable contacts slide from the neutral position to the second operating position.

In accordance with a second aspect of the invention, there is provided a sliding switch including: a first group of fixed contacts having a first common fixed contact, a first positive fixed contact, and a first negative fixed contact; a second group of fixed contacts having a second common fixed contact connected to the first common fixed contact via a load, a second positive fixed contact, and a second negative fixed contact; a first movable contact disposed so as to slide between a first operating position and a second operating position with a neutral position placed therebetween and to slide on the first group of fixed contacts as the first movable contact slides, the first movable contact being adapted to contact the first common fixed contact and one of the first positive and negative fixed contacts in the neutral position and the first operating position and to contact the first common fixed contact and the other one of the first positive and negative fixed contacts in the second operating position; and a second movable contact disposed so as to slide between the first operating position and the second operating position with the neutral position placed therebetween in synchronism with the first movable contact and to slide on the second group of fixed contacts as the second movable contact slides, the second movable contact being adapted to contact the second common fixed contact and one of the second positive and negative fixed contacts in the neutral position and the second operating position and to contact the second common fixed contact and the other one of the second positive and negative fixed contacts in the first operating position, the sliding switch comprising:

a first insulation portion disposed in the first common fixed contact so as to temporarily move the first movable contact away from the first common fixed contact before the second movable contact moves away from one of the fixed contacts of the second group of fixed contacts when the first and second movable contacts slide from the first operating position to the neutral position; and a second insulation portion disposed in the second common fixed contact so as to temporarily move the second movable contact away from the second common fixed contact before the first movable contact moves away from one of the fixed contacts of the first group of fixed contacts when the first and second movable contacts slide from the second operating position to the neutral position.

In the second aspect of the invention, the sliding switch including the first and second groups of fixed contacts and the first and second movable contacts, which are arranged as described above, may be provided with:

a first insulation portion disposed in the first common fixed contact so as to temporarily move the first movable contact away from the first common fixed contact and so as to cause the first movable contact to contact again the first common fixed contact after the second movable contact has contacted one of the second positive and negative fixed contacts, when the first and second movable contacts slide from the neutral position to the first operating position; and a second insulation-portion disposed in the second common fixed contact so as to temporarily move the second movable contact away from the second common fixed contact and so as to cause the second movable contact to contact again the second common fixed contact after the first movable contact has contacted one of the first positive and negative fixed contacts, when the first and second movable contacts slide from the neutral position to the second operating position.

In the above-described first and second aspects of the invention, an arrangement may preferably be provided such that the first group of fixed contacts and the second group of fixed contacts are arranged in a row, and that the first positive fixed contact of the first group of fixed contacts and the second positive fixed contact of the second group of fixed contacts are made common, or the first negative fixed contact of the first group of fixed contacts and the second negative fixed contact of the second group of fixed contacts are made common.

In addition, the first and second insulation portions may preferably be recessed, and the sliding switch may further comprise:

a pair of first receiving portions disposed on opposite sides of the first insulation portion arranged in a direction perpendicular to a moving direction of the first movable contact such that opposite ends of the first movable contact slide on the pair of first receiving portions;

a pair of first recessed portions respectively continuing from the pair of first receiving portions and disposed at positions located along the moving direction of the first movable contact;

a pair of second receiving portions disposed on opposite sides of the second insulation portion arranged in a direction perpendicular to a moving direction of the second movable contact, such that opposite ends of the second movable contact slide on the pair of second receiving portions; and a pair of second recessed portions respectively continuing from the pair of second receiving portions and disposed at positions located along the moving direction of the second movable contact.

In both aspects of the invention, when the first and second movable contacts slide between the neutral position and the first operating position, arcs are produced solely between the first movable contact and the first positive or negative fixed contact in which the first insulation portion is provided. Meanwhile, when the first and second movable contacts slide between the neutral position and the second operating position, arcs are produced solely between the second movable contact and the second positive or negative fixed contact in which the second iii portion is provided.

At this time, the first iii portion is located in the area of the first positive or negative fixed contact, while the second iii portion is located in the area of the second positive or negative fixed contact. Hence, even if metal powders due to the arcs are produced in the first and second iii portions, the insulation performance does not decline between the fixed contacts of different polarities.

In the case where the first group of fixed contacts and the second group of fixed contacts are arranged in a row, there is an advantage in that a space in a direction perpendicular to the moving direction of the movable contact can be reduced as compared with the case where the two groups of fixed contacts are arranged in parallel.

Also, at that time, if the first positive fixed contact of the first group of fixed contacts and the second positive fixed contact of the second group of fixed contacts are made common, or the first negative fixed contact of the first group of fixed contacts and the second negative fixed contact of the second group of fixed contacts are made common, there is an advantage in that a space in the moving direction of the movable contact can be reduced as compared with the case where the two groups of fixed contacts are arranged simply in a row.

Furthermore, as the first and second insulation portions are formed into recesses, the metal powders and the like produced by the arcs fall into the recesses, so that a decline in the insulation performance can be prevented more reliably.

In the case where the first and second insulation portions are formed into recesses, there is the possibility of the first and second movable contacts giving rise to play when they pass over the first and second insulation portions, respectively. However, since the first and second receiving portions on which the opposite ends of the first and second movable contacts slide are provided on the opposite sides of the first and second insulation portions, respectively, it is possible to prevent the play.

In addition, since the first and second recessed portions continuing from the first and second receiving portions are provided, even if worn powders are produced as a result of the sliding of the first and second movable contacts on the first and second receiving portions, the worn powders fall into the first and second recessed portions, respectively. Hence, it is possible to prevent a decline in the sliding resistance of the first and second movable contacts due to the worn powders.

In accordance with the structure of the sliding switch contacts according to the first aspect of the invention, when the first and second movable contacts slide between the neutral position and the first operating position, arcs are produced solely between the first movable contact and the first positive or negative fixed contact in which the first insulation portion is provided. Meanwhile, when the first and second movable contacts slide between the neutral position and the second operating-position, arcs are produced solely between the second movable contact and the second positive or negative fixed contact in which the second insulation portion is provided.

At this time, the first insulation portion is located in the area of the first positive or negative fixed contact, while the second insulation portion is located in the area of the second positive or negative fixed contact. Hence, even if metal powders due to the arcs are produced in the first and second insulation portions, it is possible to reliably prevent a decline in the insulation performance between the fixed contacts of different polarities.

In accordance with the structure of the sliding switch contacts according to the second aspect of the invention, when the first and second movable contacts slide between the neutral position and the first operating position, arcs are produced solely between the first movable contact and the first common fixed contact in which the first insulation portion is provided. Meanwhile, when the first and second movable contacts slide between the neutral position and the second operating position, arcs are produced solely between the second movable contact and the second common fixed contact in which the second insulation portion is provided.

At this time, the first insulation portion is located in the area of the first common-fixed contact, while the second insulation portion is located in the area of the second common fixed contact. Hence, even if metal powders due to the arcs are produced in the first and second insulation portions, it is possible to reliably prevent a decline in the insulation performance between the fixed contacts of different polarities.

Furthermore, in the above-described first and second aspects of the invention, in the case where the first group of fixed contacts and the second group of fixed contacts are arranged in a row, there is an advantage in that a space in a direction perpendicular to the moving direction of the movable contact can be reduced as compared with the case where the two groups of fixed contacts are arranged in parallel. In addition, if the first positive fixed contact of the first group of fixed contacts and the second positive fixed contact of the second group of fixed contacts are made common, or the first negative fixed contact of the first group of fixed contacts and the second negative fixed contact of the second group of fixed contacts are made common, there is an advantage in that a space in the moving direction of the movable contact can be reduced as compared with the case where the two groups of fixed contacts are arranged simply in a row.

Furthermore, as the first and second insulation portions are formed into-recesses, the metal powders and the like produced by the arcs are allowed to fall into the recesses, so that a decline in the insulation performance can be prevented more reliably.

In the case where the first and second insulation portions are formed into recesses, there is the possibility of the first and second movable contacts giving rise to play when they pass over the first and second insulation portions, respectively. However, since the first and second receiving portions on which the opposite ends of the first and second movable contacts slide are provided on the opposite sides of the first and second insulation portions, respectively, it is possible to prevent the play.

In addition, since the first and second recessed portions continuing from the first and second receiving portions are provided, even if worn powders are produced as a result of the sliding of the first and second movable contacts on the first and second receiving portions, the worn powders fall into the first and second recessed portions, respectively. Hence, it is possible to prevent a decline in the sliding resistance of the first and second movable contacts due to the worn powders.

The above and other objects, features and advantages of the present invention will become more apparent from the following description of the invention when read in conjunction with the accompanying drawings.

DESCRIPTION OF THE PREFERRED EMBODIMENTS

Referring now to FIGS. 1 to 5, a description will be given of a first embodiment in which the present invention is applied to a switch for a window regulator of an automobile.

Figure 1:
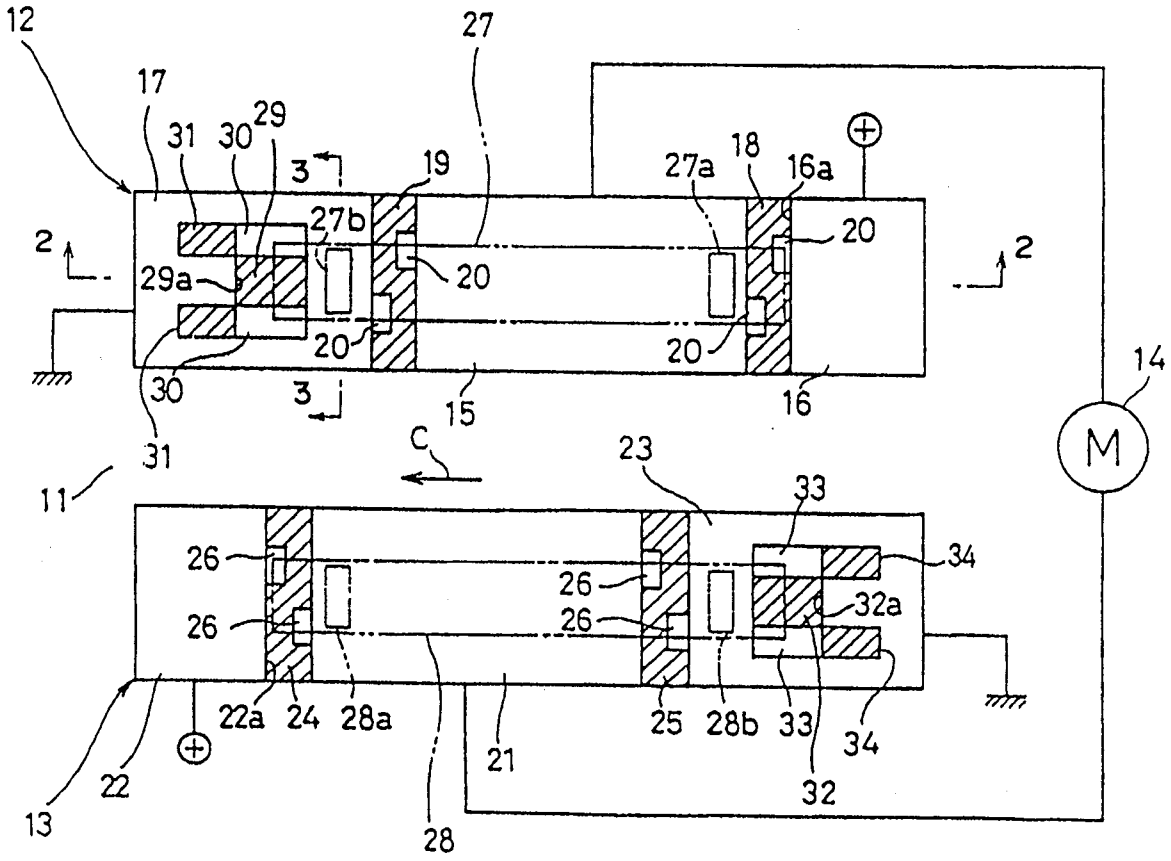
FIG. 1 is a plan view of essential portions and illustrates a basic principle of a first embodiment of the present invention.
Figure 2:
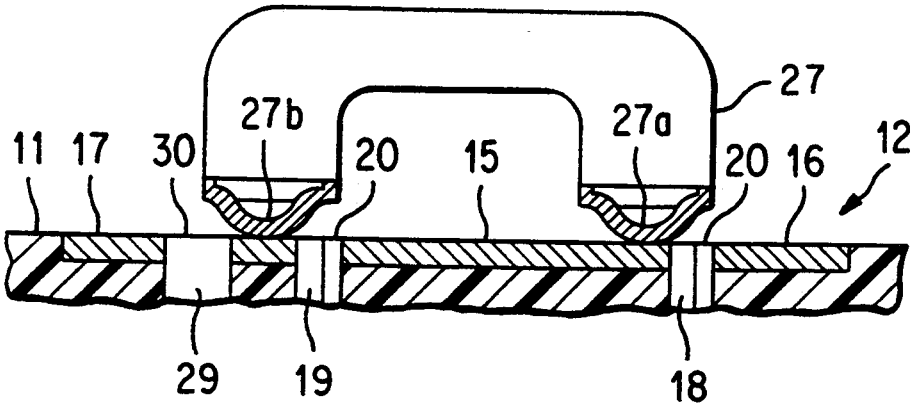
FIG. 2 is a cross-sectional view taken along 2—2 in FIG. 1.
Figure 3:
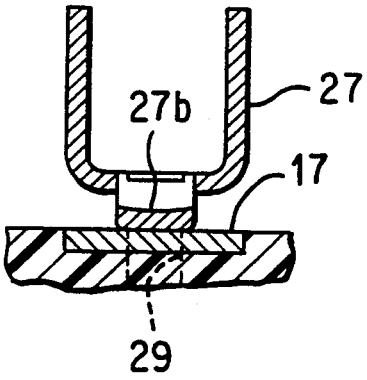
FIG. 3 is a cross-sectional view taken along 3—3 in FIG. 1.

First, in FIGS. 1 to 3, a substrate 11 is formed of a synthetic resin made of an insulating material. A first group 12 of fixed contacts and a second group 13 of fixed contacts are disposed on the substrate 11 in parallel with each other.

The first group 12 of fixed contacts comprises a first common fixed contact 15 connected to a reversible motor 14 serving as a load, a first positive fixed contact 16 connected to a positive terminal of a power source, and a first negative fixed contact 17 connected to a negative terminal of the power source via a ground connection.

Insulation space portions 18, 19 (indicated by oblique lines in FIG. 1 for convenience' sake), which are respectively formed by holes, are disposed between the first common fixed contact 15 and the first positive fixed contact 16 and between the first common fixed contact 15 and the first negative fixed contact 17. Also, two guide portions 20, which are made of an insulating material and whose upper surfaces are flush with upper surfaces of the fixed contacts 15, 16, 17, are disposed in each of the insulation space portions 18, 19. Each guide portion 20 is formed integrally with the substrate 11.

In the same way as the first group 12 of fixed contacts, the second group 13 of fixed contacts comprises a second common fixed contact 21 connected to the first common fixed contact 15 via the motor 14, a second positive fixed contact 22 connected to the positive terminal of the power source, and a second negative fixed contact 23 connected to the negative terminal of the power source via a ground connection.

Insulation space portions 24, 25 (also indicated by oblique lines in FIG. 1), which are respectively formed by holes, are disposed between the second common fixed contact 21 and the second positive fixed contact 22 and between the second common fixed contact 21 and the second negative fixed contact 23. Also, two guide portions 26, which are made of the insulating material and whose upper surfaces are flush with upper surfaces of the fixed contacts 21, 22, 23, are disposed in each of the insulation space portions 24, 25. Each guide portion 26 is formed integrally with the substrate 11 in the same way as the guide portions 20.

A first movable contact 27 which slides on the first group 12 of fixed contacts and a second movable contact 28 which slides on the second group 13 of fixed contacts are mounted on an unillustrated contact holder. These first and second movable contacts 27, 28 are adapted to slide simultaneously in the direction of arrow C in FIG. 1 and in an opposite direction thereto.

Figure 4:
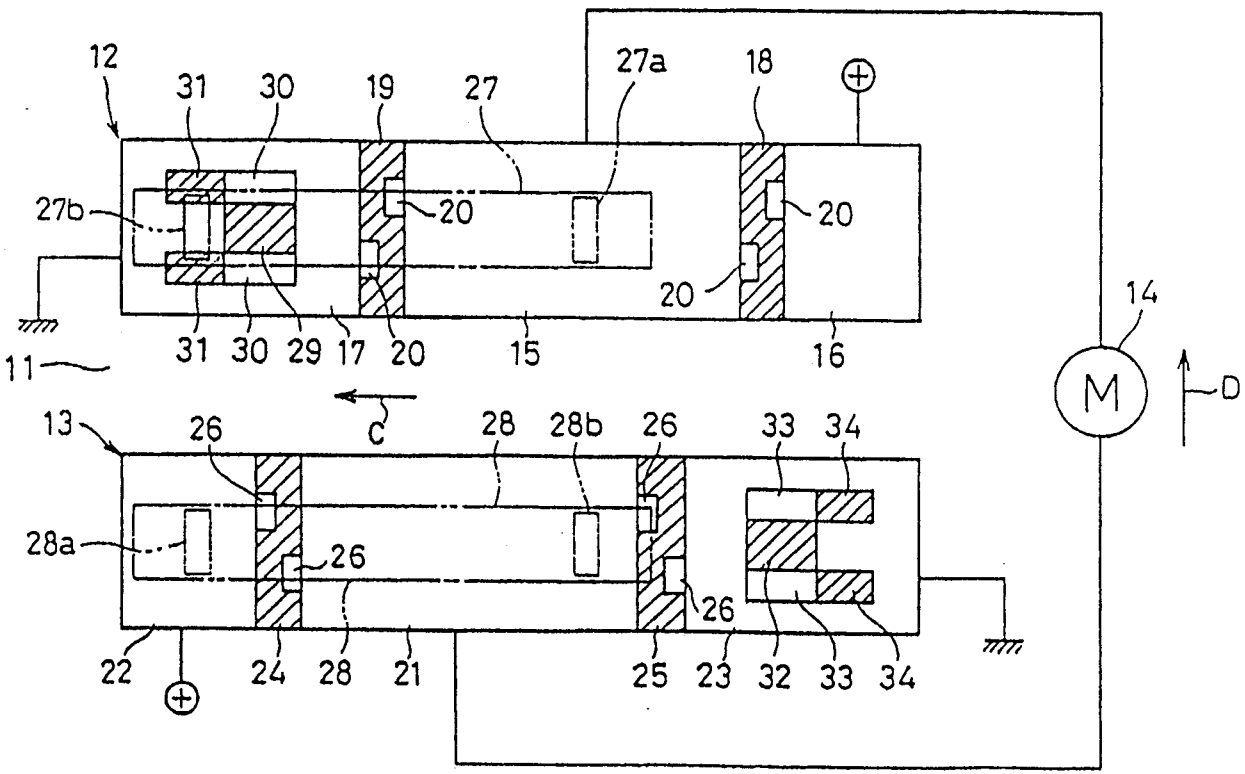
FIG. 4 is a diagram similar to FIG. 1 but showing a state in which first and second movable contacts have moved to a first operating position.
Figure 5:
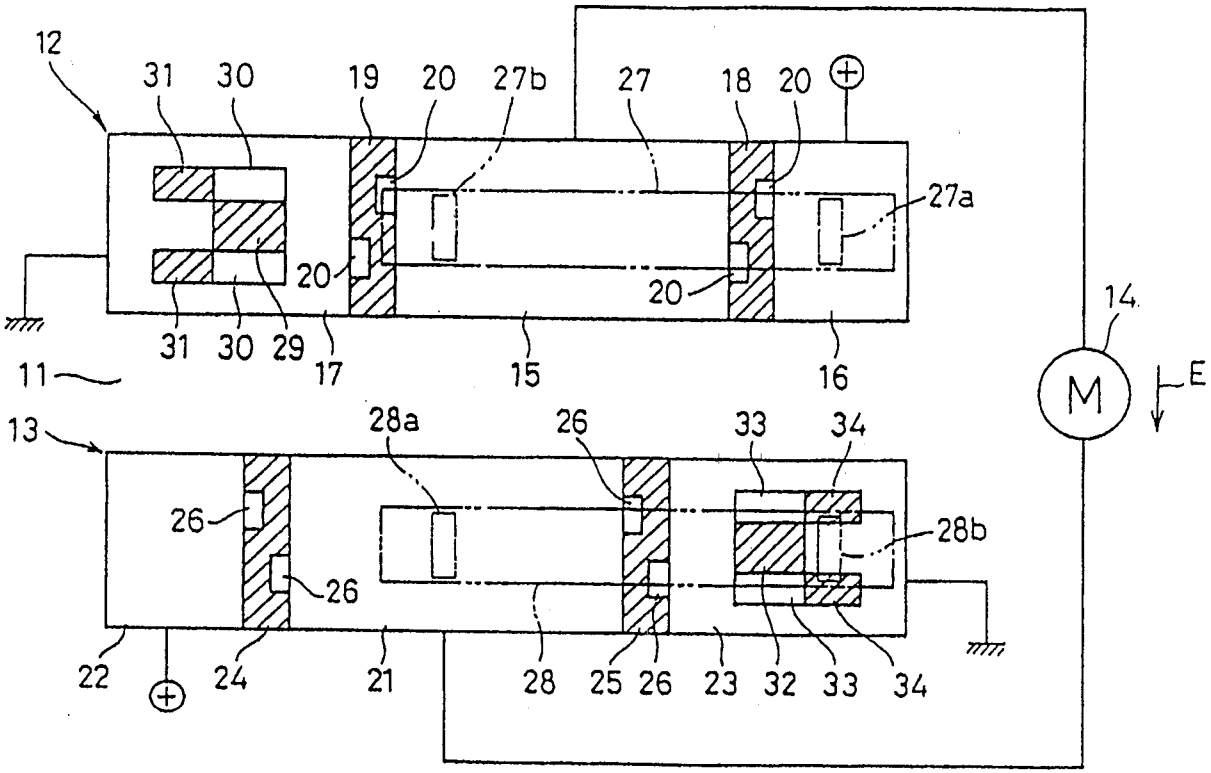
FIG. 5 is a diagram similar to FIG. 1 but showing a state in which the first and second movable contacts have moved to a second operating position.

In addition, these first and second movable contacts 27, 28 are adapted to slide between a first operating position shown in FIG. 4 and a second operating position shown in FIG. 5 with a neutral position shown in FIG. 1 placed therebetween.

As shown in FIGS. 2 and 3, the first movable contact 27 has contact portions **27*a*, 27*b* located on both left- and right-hand sides and projecting with a downwardly convex shape. Similarly, the second movable contact 28 has contact portions 28*a*, 28*b* located on both left- and right-hand sides and projecting with a downwardly convex shape, although not shown in FIGS. 2 and 3. The contact portions 27*a*, 27*b*, and 28*a*, 28*b* are adapted to slide and move into contact with and away from the fixed contacts 15, 16, 17, and 21, 22, 23**, respectively.

In the first negative fixed contact 17 in the first group 12 of fixed contacts, a recessed first insulation portion 29 (indicated by oblique lines for convenience' sake) formed by a hole is disposed in a sliding area of the contact portion **27*b* of the first movable contact 27**.

The first recessed insulation portion 29 is so arranged that a left-hand side edge **29*a* thereof is located on the arrow C's direction side (left-hand side) with respect to a right-hand side edge 22*a* (a left-hand side edge of the insulation space portion 24) of the second positive fixed contact 22 in the second group 13 of fixed contacts. At the same time the transverse dimension of the first recessed insulation portion 29 is set to be smaller than the transverse dimension (a dimension in a direction perpendicular to the moving direction of the contact portion 27*b*) of the contact portion 27*b*, as shown in FIG. 1. It should be noted that the term "transverse" referred to herein means the transverse direction of each of the first and second groups 12, 13** of fixed contacts.

On both transverse sides of the above-described first recessed insulation portion 29, which are arranged in a direction perpendicular to the moving direction of the first movable contact 27, a pair of first receiving portions 30 made of the insulating material are disposed such that their upper surfaces are flush with an upper surface of the first negative fixed contact 17. These first receiving portions 30 are also formed integrally with the substrate 11.

On the left-hand sides, as viewed in the moving direction of the first movable contact 27, of the pair of first receiving portions 30, a pair of first recessed portions 31 (also indicated by oblique lines) formed by holes are respectively provided in such a manner as to continue from the respective first receiving portions 30.

In addition, in the second negative fixed contact 23 of the second group 13 of fixed contacts, a recessed second insulation portion 32 (also indicated by oblique lines) formed by a hole is provided in a sliding area of the contact portion **28*b* of the second movable contact 28**.

The second recessed insulation portion 32 is so arranged that a right-hand side edge **32*a* thereof is located on the arrow C's opposite direction side (right-hand side) with respect to a left-hand side edge 16*a* (a right-hand side edge of the insulation space portion 18) of the first positive fixed contact 16 in the first group 12 of fixed contacts. At the same time, the transverse dimension of the second recessed insulation portion 32 is set to be smaller than the transverse dimension (a dimension in a direction perpendicular to the moving direction of the contact portion 28*b*) of the contact portion 28*b*, as shown in FIG. 1**.

On both transverse sides of the above-described second insulation portion 32, which are arranged in a direction perpendicular to the moving direction of the second movable contact 28, a pair of second receiving portions 33 made of the insulating material are disposed such that their upper surfaces are flush with an upper surface of the second negative fixed contact 23. These second receiving portions 33 are also formed integrally with the substrate 11.

On the right-hand sides, as viewed in the moving direction of the second movable contact 28, of the pair of second receiving portions 33, a pair of second recessed portions 34 (also indicated by oblique lines) formed by holes are respectively provided in such a manner as to continue from the respective second receiving portions 33.

A description will now be given of the above-described arrangement. Now, in the state in which the first and second movable contacts 27, 28 are located in the neutral position shown in FIG. 1, the contact portions 27*a*, 27*b* of the first movable contact 27 are in contact with the first common fixed contact 15 and the first negative fixed contact 17, respectively, while the contact portions 28*a*, 28*b* of the second movable contact 28 are in contact with the second common fixed contact 21 and the second negative fixed contact 23, respectively. In this state, the motor 14 is in a deenergized state and is in a neutral state.

When, upon operation of the switch, the first and second movable contacts 27, 28 slide in the direction of arrow C from the aforementioned neutral position and reach the first operating position shown in FIG. 4, the contact portions 27*a*, 27*b* of the first movable contact 27 respectively remain in contact with the first common fixed contact 15 and the first negative fixed contact 17. However, the contact portions 28*a*, 28*b* of the second movable contact 28 are changed over to a state in which they are brought into contact with the second common fixed contact 21 and the second positive fixed contact 22.

In this state, electric current flows across the motor 14 in the direction of arrow D, and the motor 14 is thereby rotated forwardly, which in turn causes the window glass to be raised and set in a raised state.

On the other hand, when, upon operation of the switch, the first and second movable contacts 27, 28 slide in the opposite direction to that of arrow C from the neutral position and reach the second operating position shown in FIG. 5, the contact portions 28*a*, 28*b* of the second movable contact 28 respectively remain in contact with the second common fixed contact 21 and the second negative fixed contact 23. However, the contact portions 27*a*, 27*b* of the first movable contact 27 are changed over to a state in which they are brought into contact with the first common fixed contact 15 and the first positive fixed contact 16.

In this state, electric current flows across the motor 14 in the direction of arrow E, and the motor 14 is thereby rotated reversely, which in turn causes the window glass to be lowered and set in a lowered state.

It should be noted that if the switch operation is canceled, the first and second movable contacts 27, 28 are automatically reset to the neutral position shown in FIG. 1.

When the first and second movable contacts 27, 28 slide from the neutral position to the first operating position, the contact portion 27*b* on the left-hand side of the first movable contact 27 temporarily moves away from the first negative fixed contact 17 in correspondence with the first insulation portion 29, and is then brought again into contact with the first negative fixed contact 17 after the contact portion 28*a* on the left-hand side of the second movable contact 28 has contacted the second positive fixed contact 22. When the contact portion 27*b* of the first movable contact 27 is brought again into contact with the first negative fixed contact 17, an arc is produced between the contact portion 27*b* and the first negative fixed contact 17.

Meanwhile, when the first and second movable contacts 27, 28 slide from the first operating position to the neutral position, the contact portion 27*b* on the left-hand side of the first movable contact 27 temporarily moves away from the first negative fixed contact 17 in correspondence with the first insulation portion 29 before the contact portion 28*a* on the left-hand side of the second movable contact 28 moves away from the second positive fixed contact 22. The contact portion 27*b* is then brought again into contact with the first negative fixed contact 17 after the contact portion 28*a* of the second movable contact 28 has moved away from the second positive fixed contact 22. When the contact portion 27*b* of the first movable contact 27 moves away from the first negative fixed contact 17, an arc is produced between the contact portion 27*b* and the first negative fixed contact 17.

On the other hand, when the first and second movable contacts 27, 28 slide from the neutral position to the second operating position, the contact portion 28*b* on the right-hand side of the second movable contact 28 temporarily moves away from the second negative fixed contact 23 in correspondence with the second insulation portion 32, and is then brought again into contact with the second negative fixed contact 23 after the contact portion 27*a* on the right-hand side of the first movable contact 27 is brought into contact with the first positive fixed contact 16. When the contact portion 28*b* of the second movable contact 28 is brought again into contact with the second negative fixed contact 23, an arc is produced between the contact portion 28*b* and the second negative fixed contact 23.

Meanwhile, when the first and second movable contacts 27, 28 slide from the second operating position to the neutral position, the contact portion 28*b* on the right-hand side of the second movable contact 28 temporarily moves away from the second negative fixed contact 23 in correspondence with the second insulation portion 32 before the contact portion 27*a* on the right-hand side of the first movable contact 27 moves away from the first positive fixed contact 16. The contact portion 28*b* is then brought again into contact with the second negative fixed contact 23 after the contact portion 27*a* of the first movable contact 27 has moved away from the first positive fixed contact 16. When the contact portion 28*b* of the second movable contact 28 moves away from the second negative fixed contact 23, an arc is produced between the contact portion 28*b* and the second negative fixed contact 23.

Accordingly, in this case, when the first and second movable contacts 27, 28 slide between the neutral position and the first operating position, arcs are produced solely between the contact portion 27*b* of the first movable contact 27 and the first negative fixed contact 17 in which the first insulation portion 29 is provided. Meanwhile, when the first and second movable contacts 27, 28 slide between the neutral position and the second operating position, arcs are produced solely between the contact portion 28*b* of the second movable contact 28 and the second negative fixed contact 23 in which the second insulation portion 32 is provided.

At this time, even if metal powders or the like due to the arcs are produced at the first and second insulation portions 29, 32, the first insulation portion 29 is located in the area of the first negative fixed contact 17, and the second insulation portion 32 is located in the area of the second negative fixed contact 23. Moreover, the metal powders and the like drop into the first and second insulation portions 29, 32 formed by holes. Therefore, the insulation performance does not decline between the fixed contacts of different polarities.

Since the first and second insulation portions 29, 32 are formed by holes, when the first and second movable contacts 27, 28 pass over the first and second insulation portions 29, 32, the contact portions 27*b*, 28*b* could enter the first and second insulation portions 29, 32 and give rise to play. However, since the first and second receiving portions 30, 33 on which the opposite ends of the first and second movable contacts 27, 28 slide are disposed on the transverse sides of the first and second insulation portions 29, 32, it is possible to prevent the play of the first and second movable contacts 27, 28.

In addition, even if worn powders are produced as a result of the sliding of the first and second movable contacts 27, 28 on the first and second receiving portions 30, 33, the worn powders fall into the first and second recessed portions 31, 34. Hence, it is possible to prevent a situation in which the sliding resistance of the first and second movable contacts 27, 28 increases due to the worn powders.

Moreover, in the above-described embodiment, since the insulation space portions 18, 19 in the first group 12 of fixed contacts and the insulation space portions 24, 25 in the second group 13 of fixed contacts are respectively formed by holes, even if worn powders are produced when the first and second movable contacts 27, 28 slide on the first and second groups 12, 13 of fixed contacts, the worn powders fall into the insulation space portions 18, 19, and 24, 25 and into the first and second insulation portions 29, 32. Therefore, it is possible to reliably prevent a situation in which the insulation performance declines and the sliding resistance increases due to the worn powders.

In addition, since the guiding portions 20, 26 are provided in the insulation space portions 18, 19, and 24, 25, it is possible to prevent the play of the first and second movable contacts 27, 28 by means of the guiding portions 20, 26.

Although, in the above-described embodiment, the first and second insulation portions 29, 32, the first and second recessed portions 31, 34, and the insulation space portions 18, 19, and 24, 25 are respectively formed by holes, it goes without saying that there portions may be formed by recesses. Alternatively, these portions may be formed of an insulating material with their upper surfaces flush with the fixed contacts 15, 16, 17 and 21, 22, 23.

Although the first and second negative fixed contacts 17, 23 are formed in the shape of frames surrounding the first and second insulation portions 29, 32, they may be each formed in a U-shaped configuration having one side open.

Figure 6:
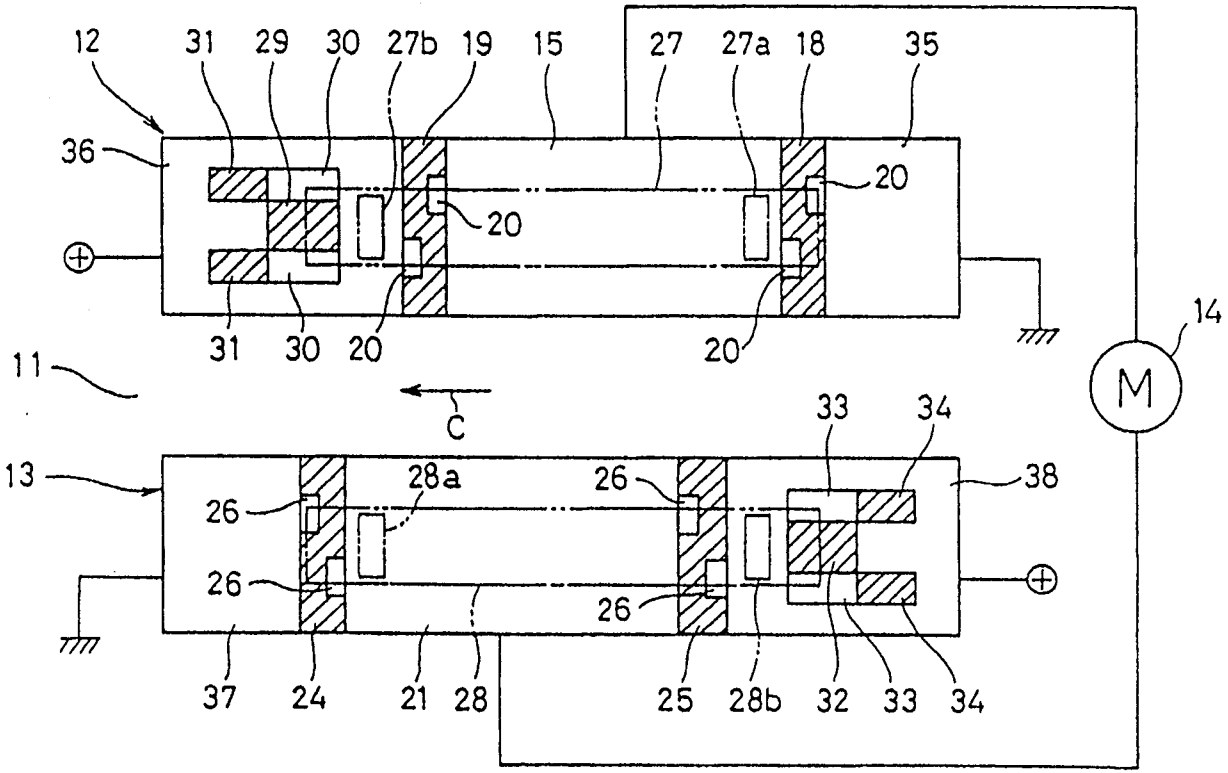
FIG. 6 is a diagram, similar to FIG. 1, of a second embodiment of the present invention.
Figure 7:
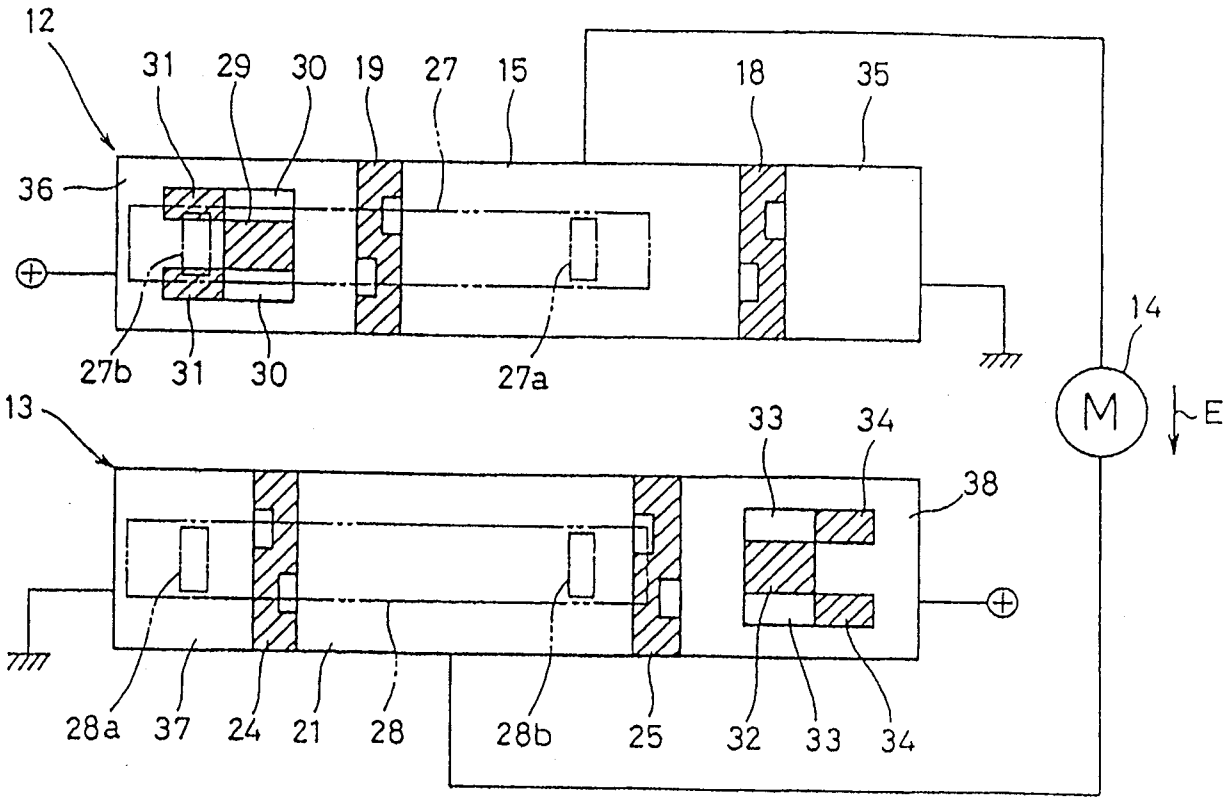
FIG. 7 is a diagram, similar to FIG. 4, of the second embodiment of the present invention.
Figure 8:
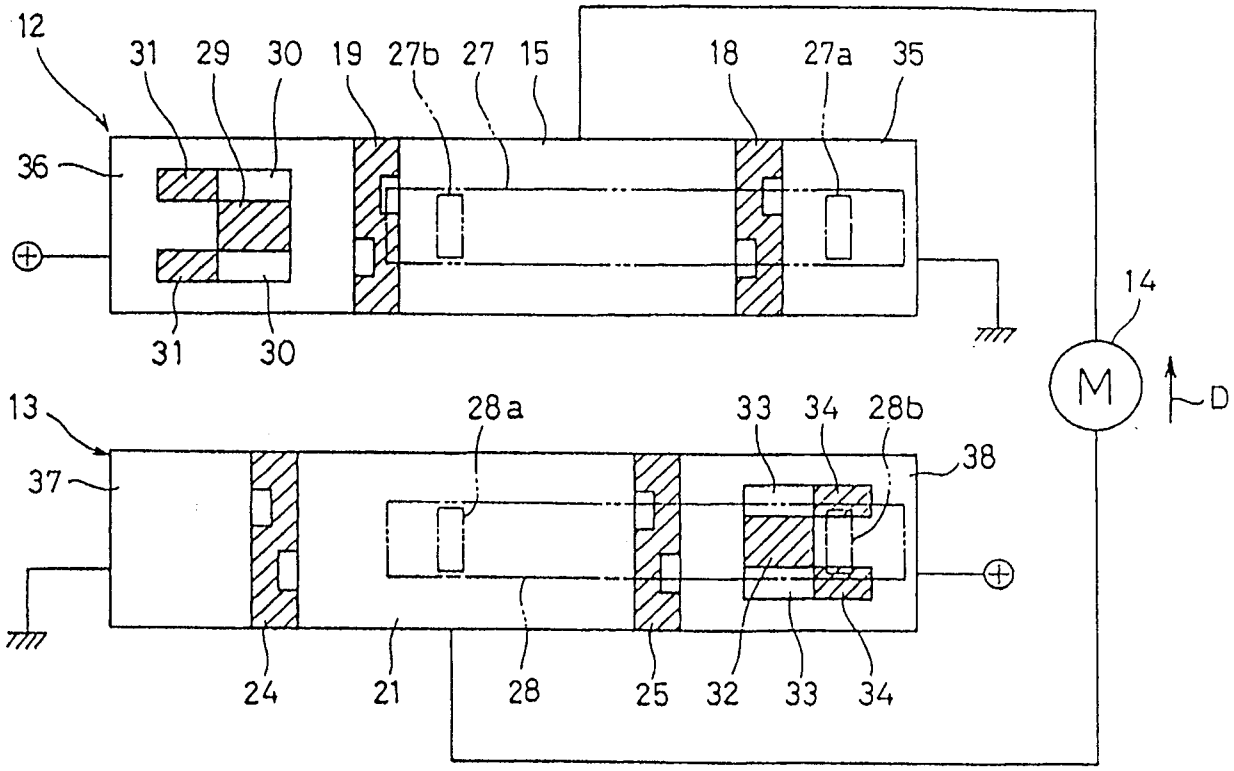
FIG. 8 is a diagram, similar to FIG. 5, of the second embodiment of the present invention.

FIGS. 6 to 8 show a second embodiment of the present invention, which differs from the above-described first embodiment in the following aspects.

Namely, in this second embodiment, the first positive fixed contact 16 and the first negative fixed contact 17 of the first group 12 of fixed contacts in the first embodiment are substituted by a first negative fixed contact 35 and a first positive fixed contact 36, respectively. In addition, the second positive fixed contact 22 and the second negative fixed contact 23 of the second group 13 of fixed contacts are substituted by a second negative fixed contact 37 and a second positive fixed contact 38, respectively.

Furthermore, the first insulation portion 29, the first receiving portions 30, and the first recessed portions 31 are disposed in the area of the first positive fixed contact 36. Meanwhile, the second insulation portion 32, the second receiving portions 33, and the second recessed portions 34 are disposed in the area of the second positive fixed contact 38.

In this switch, in a state in which the first and second movable contacts 27, 28 are located in the neutral position shown in FIG. 6, the first movable contact 27 is in contact with the first common fixed contact 15 and the first positive fixed contact 36, while the second movable contact 28 is in contact with the second common fixed contact 21 and the second positive fixed contact 38.

When the first and second movable contacts 27, 28 are moved from the neutral position to the first operating position shown in FIG. 7, the first movable contact 27 remains in contact with the first common fixed contact 15 and the first positive fixed contact 36. However, the second movable contact 28 is changed over to a state in which it is brought into contact with the second common fixed contact 21 and the second negative fixed contact 37.

On the other hand, when the first and second movable contacts 27, 28 are moved from the neutral position to the second operating position shown in FIG. 8, the second movable contact 28 remains in contact with the second common fixed contact 21 and the second positive fixed contact 38. However, the first movable contact 27 is changed over to a state in which it is brought into contact with the first common fixed contact 15 and the first negative fixed contact 35.

At this time, when the first and second movable contacts 27, 28 slide between the neutral position and the first operating position, arcs are produced solely in the first insulation portions 29. Meanwhile, when the first and second movable contacts 27, 28 slide between the neutral position and the second operating position, arcs are produced solely in the second insulation portion 32.

Figure 9:
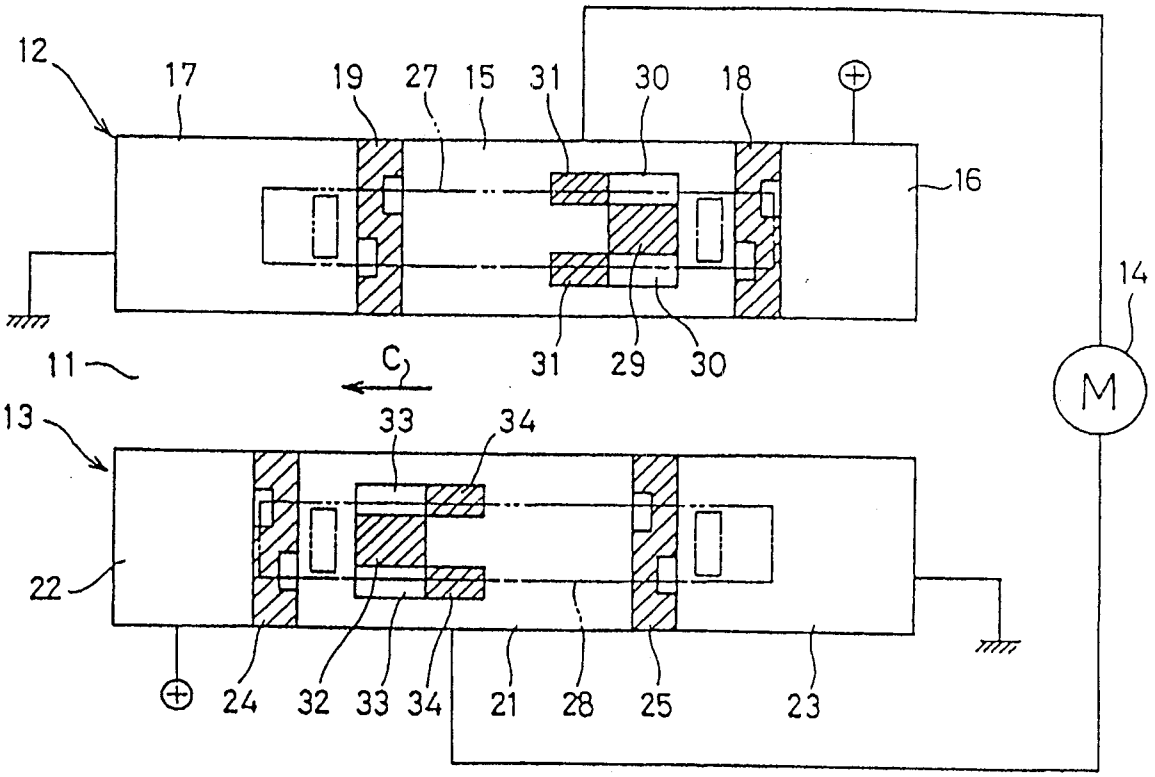
FIG. 9 is a diagram, similar to FIG. 1, of a third embodiment of the present invention.
Figure 10:
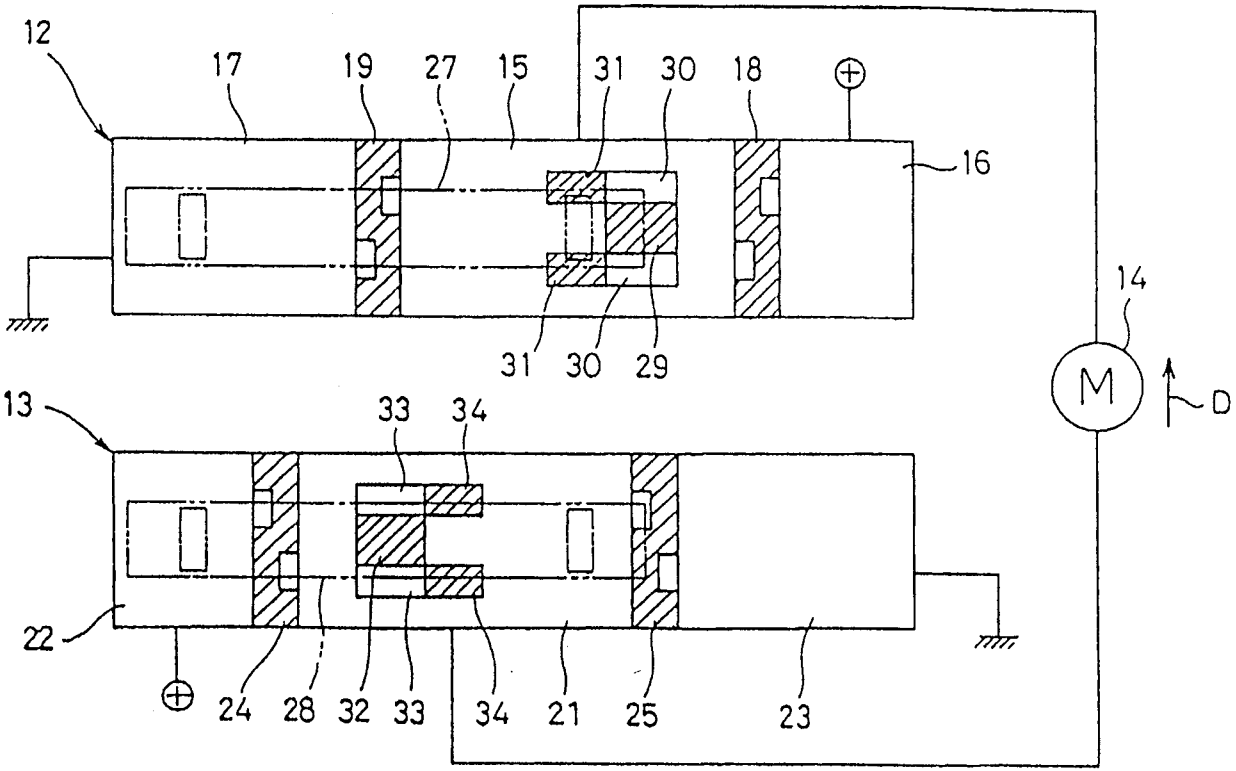
FIG. 10 is a diagram, similar to FIG. 4, of the third embodiment of the present invention.
Figure 11:
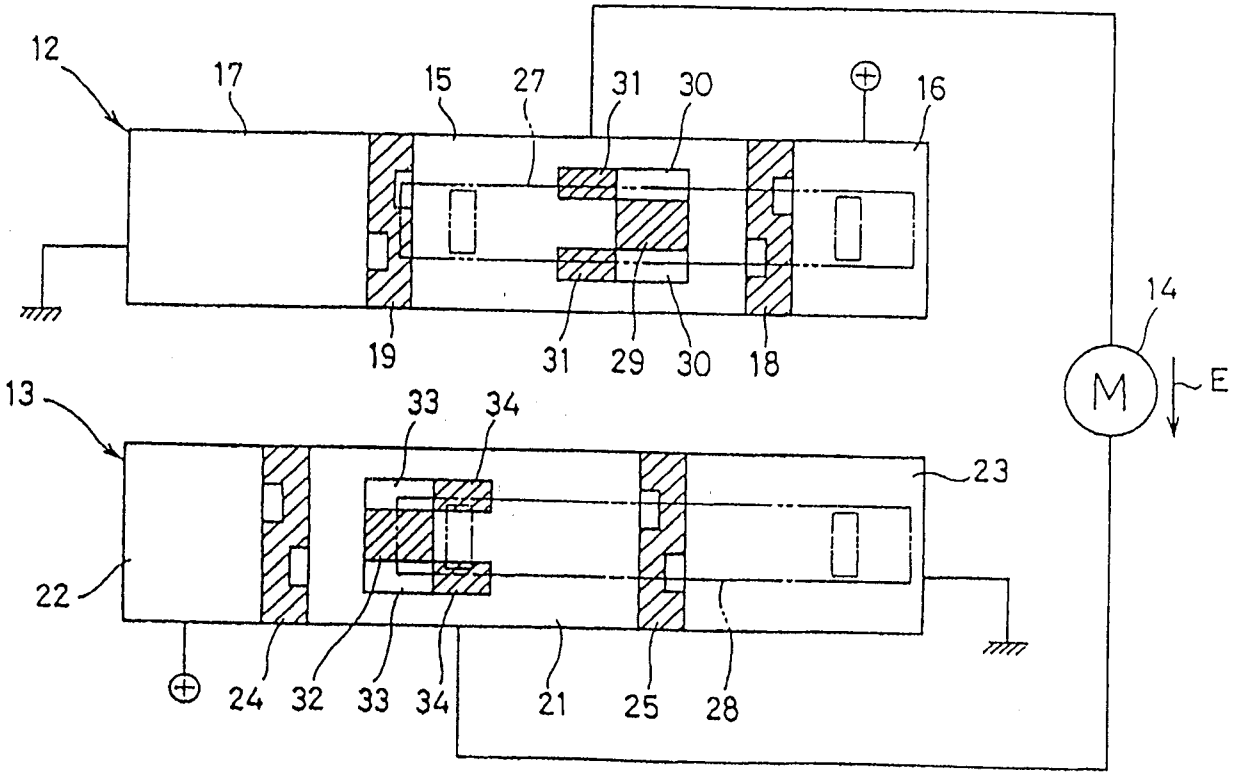
FIG. 11 is a diagram, similar to FIG. 5, of the third embodiment of the present invention.

FIGS. 9 to 11 show a third embodiment of the present invention, which differs from the first embodiment in the following aspects.

Namely, in this third embodiment, the relationship of arrangement of the first and second groups 12, 13 of fixed contacts is identical to that of the first embodiment. However, the arrangement differs from the first embodiment in that the first insulation portion 29, the first receiving portions 30, and the first recessed portions 31 are disposed in the area of the first common fixed contact 15, and in that the second insulation portion 32, the second receiving portions 33, and the second recessed portions 34 are disposed in the area of the second common fixed contact 21.

Figure 12:
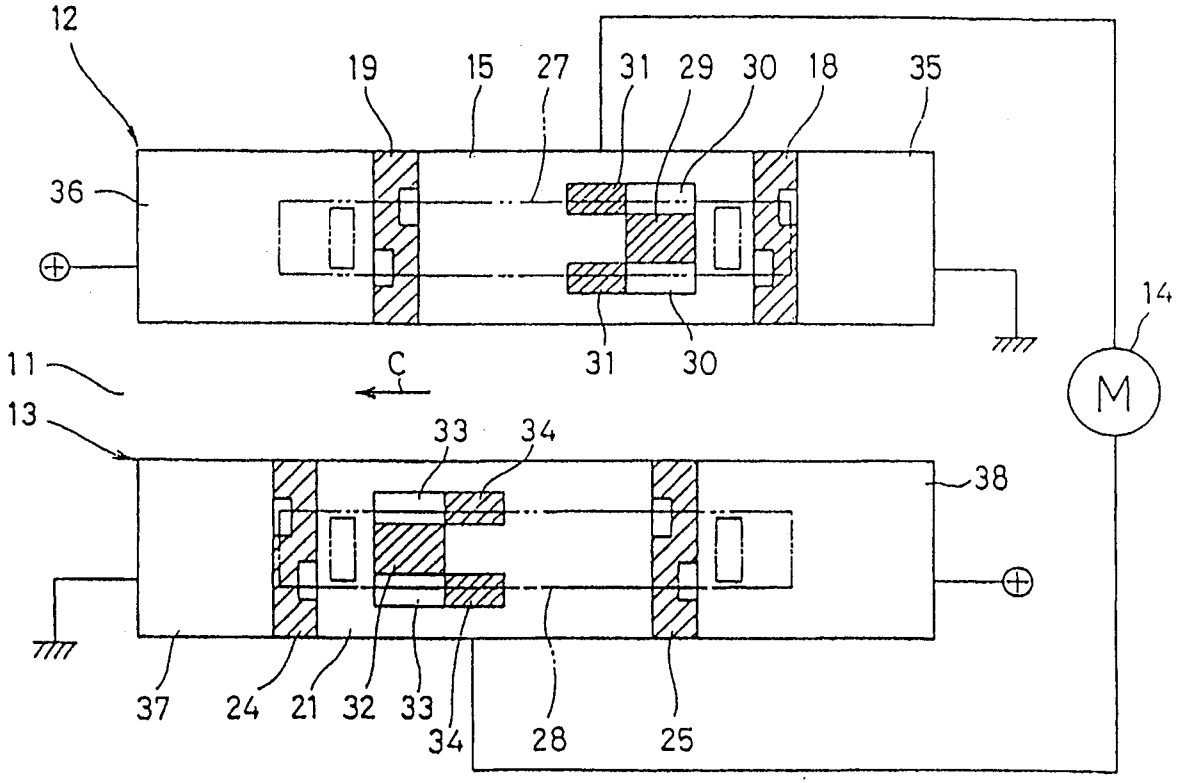
FIG. 12 is a diagram, similar to FIG. 1, of a fourth embodiment of the present invention.
Figure 13:
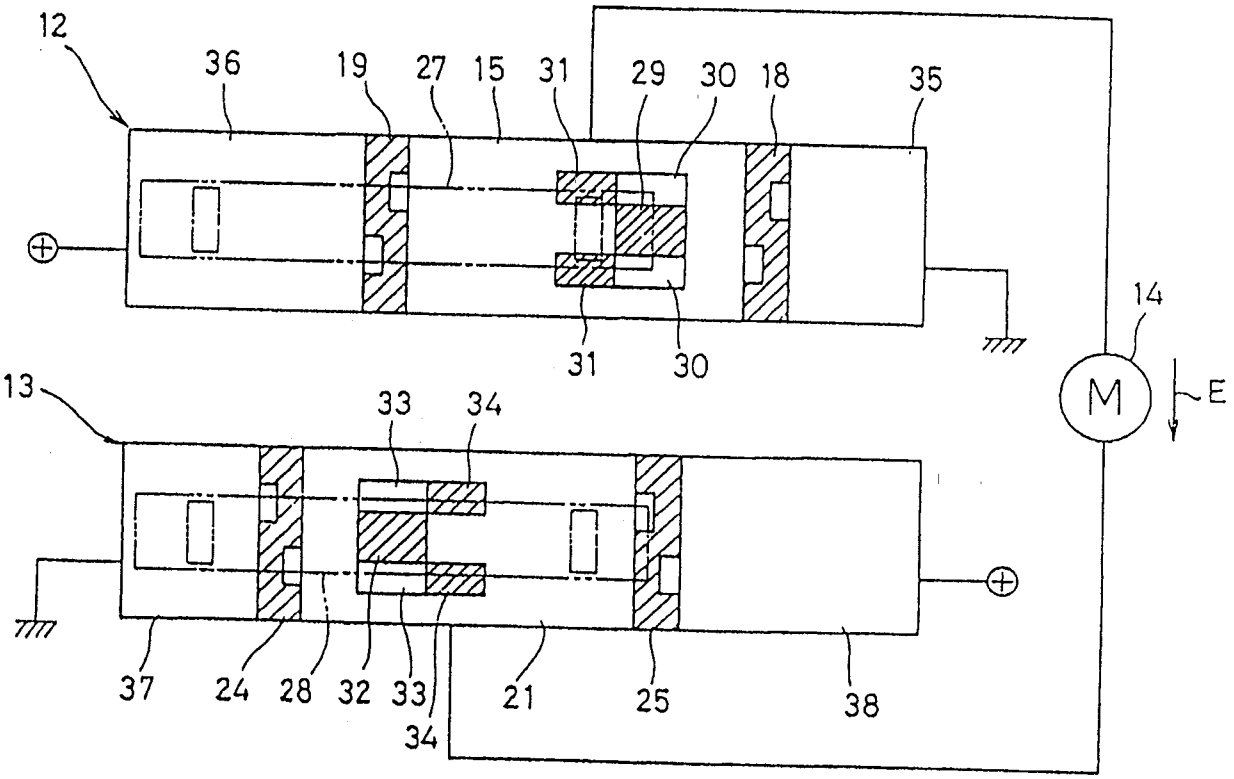
FIG. 13 is a diagram, similar to FIG. 4, of the fourth embodiment of the present invention.
Figure 14:
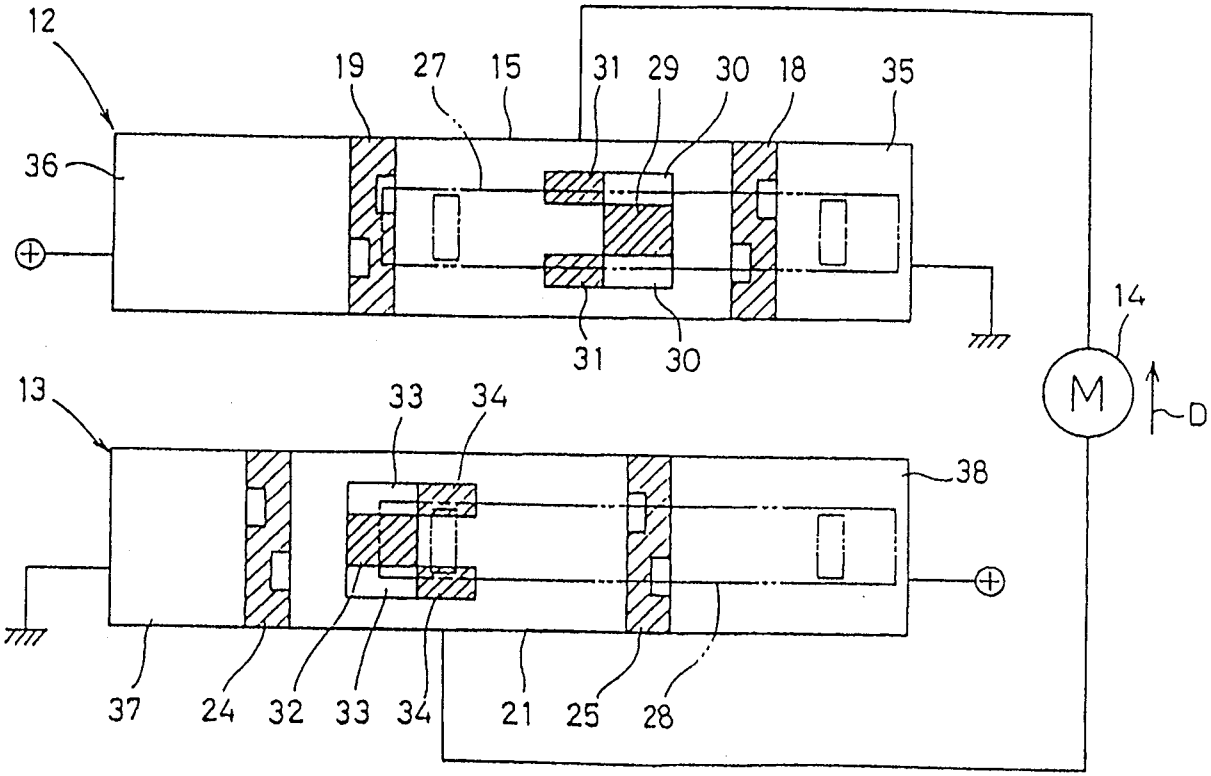
FIG. 14 is a diagram, similar to FIG. 5, of the fourth embodiment of the present invention.
Figure 15:
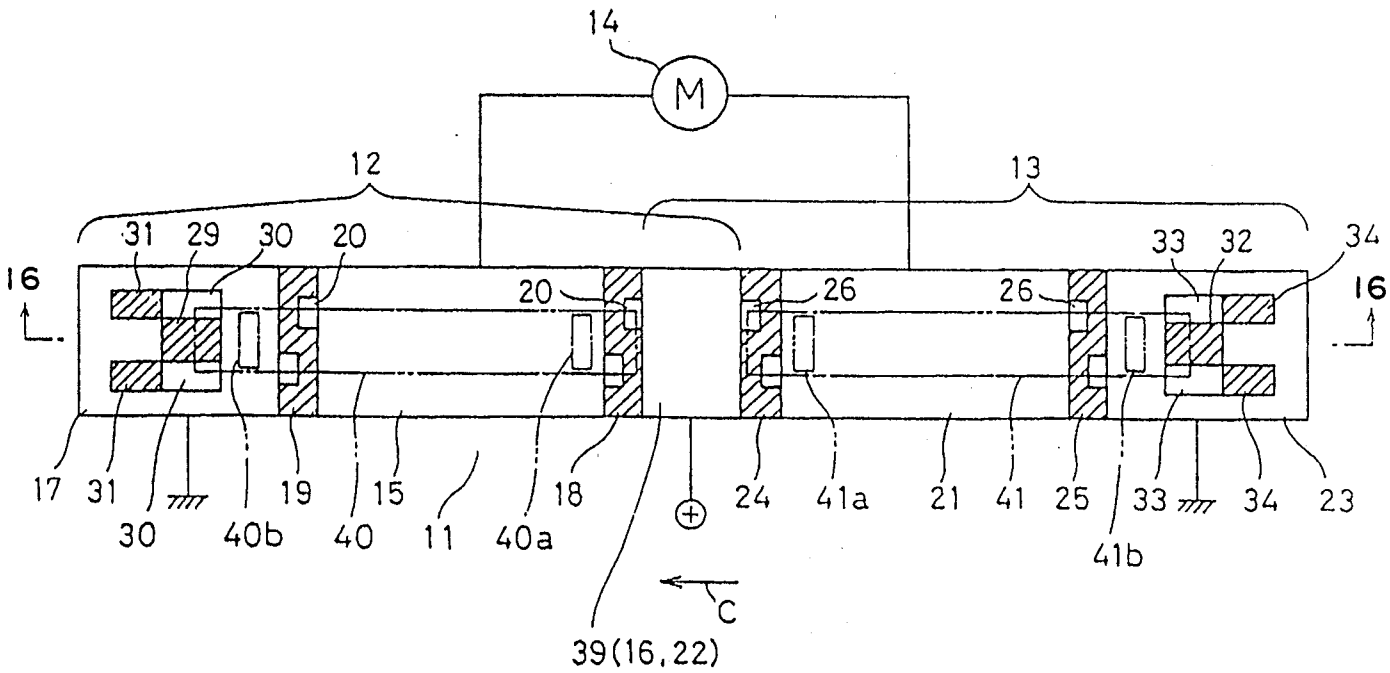
FIG. 15 is a diagram, similar to FIG. 1, of a fifth embodiment of the present invention.
Figure 16:
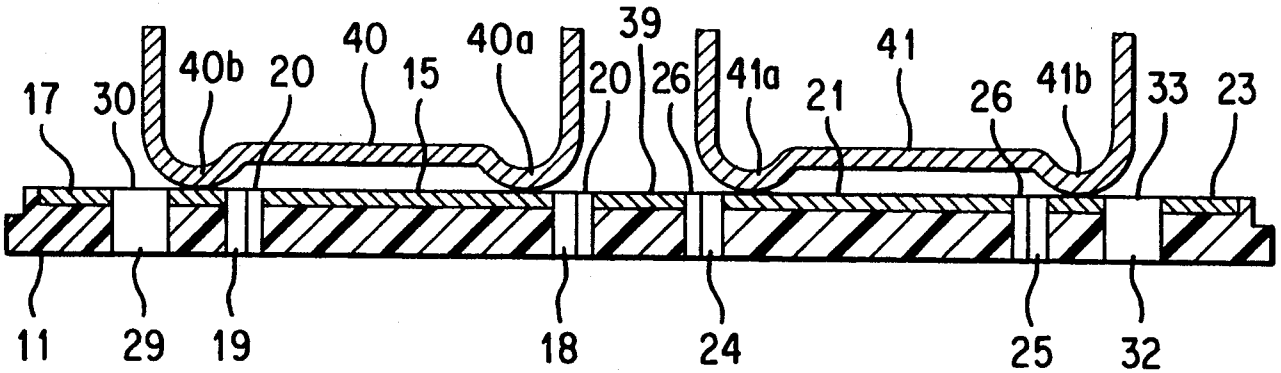
FIG. 16 is a cross-sectional view taken along 16—16 in FIG. 15.
Figure 17:
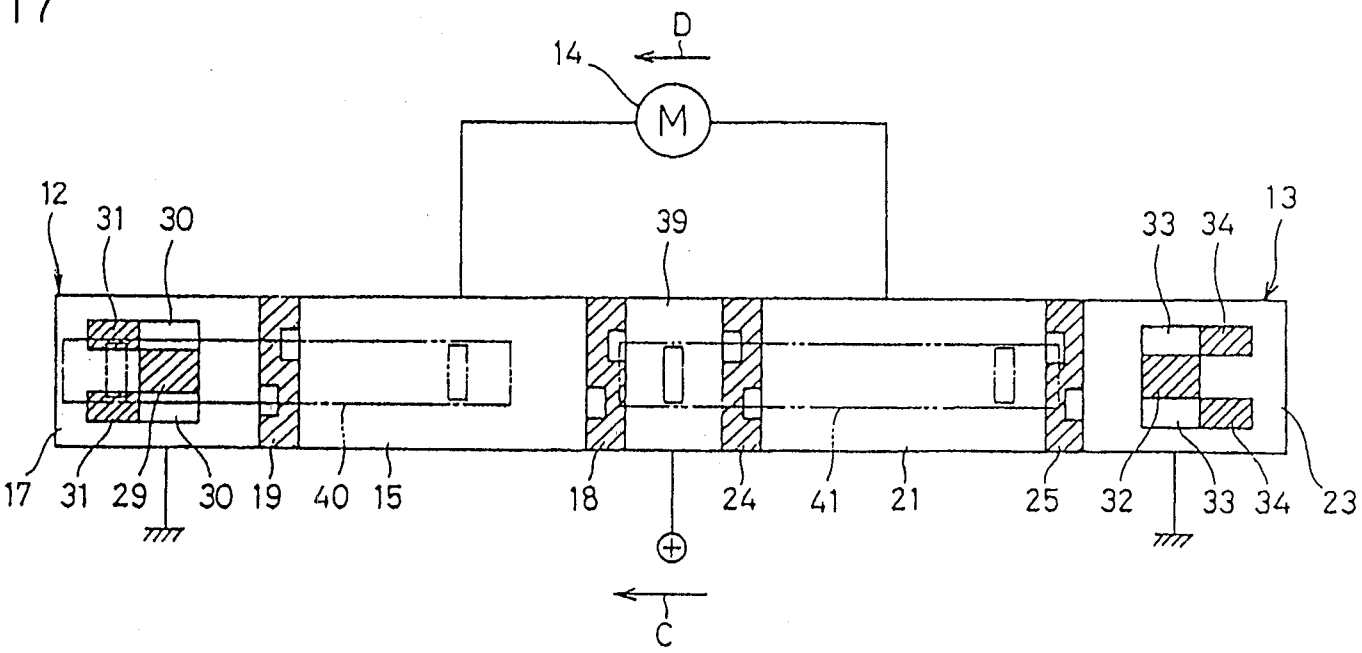
FIG. 17 is a diagram, similar to FIG. 4, of the fifth embodiment of the present invention.
Figure 18:
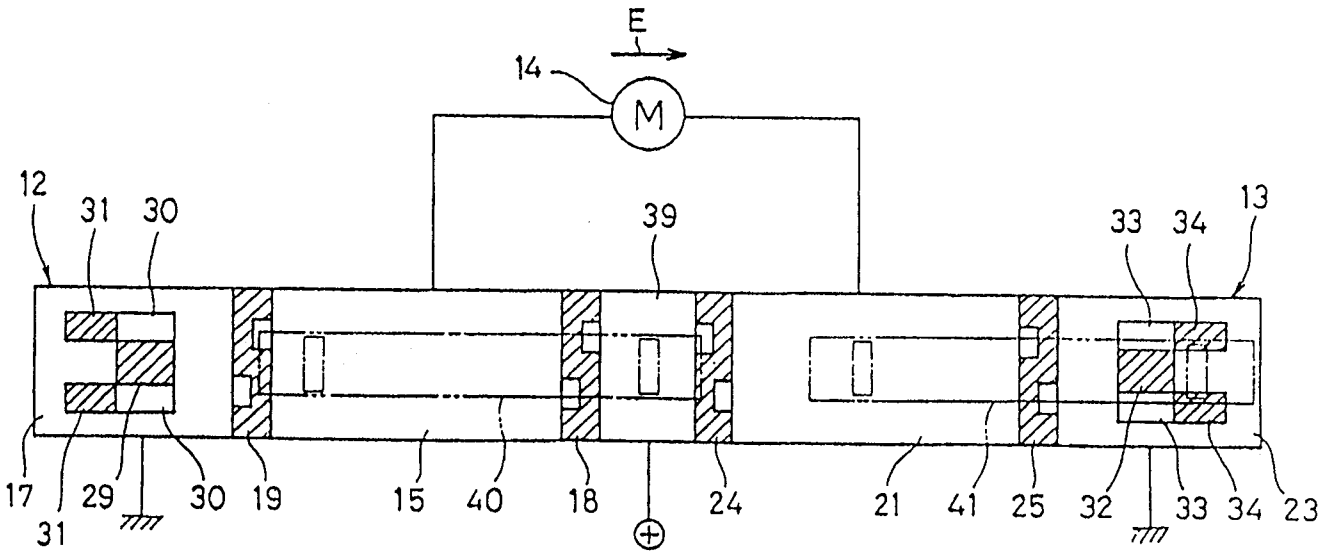
FIG. 18 is a diagram, similar to FIG. 5, of the fifth embodiment of the present invention.

FIGS. 12 to 14 show a fourth embodiment of the present invention, which differs from the second embodiment in the following aspects.

Namely, in this fourth embodiment, the relationship of arrangement of the first and second groups 12, 13 of fixed contacts is identical to that of the second embodiment. However, the arrangement differs from the second embodiment in that the first insulation portion 29, the first receiving portions 30, and the first recessed portions 31 are disposed in the area of the first common fixed contact 15, and in that the second insulation portion 32, the second receiving portions 33, and the second recessed portions 34 are disposed in the area of the second common fixed contact 21.

The second, third and fourth embodiments exhibit action and effect similar to those of the first embodiment.

FIGS. 15 to 18 show a fifth embodiment of the present invention, which differs from the first embodiment in the following aspects.

Namely, in this fifth embodiment, the first group 12 of fixed contacts and the second group 13 of fixed contacts in the first embodiment are arranged in a row (in the illustrated case, the first group 12 of fixed contacts is located on the left-hand side, and the second group 13 of fixed contacts on the right-hand side). In addition, the first positive fixed contact 16 of the first group 12 of fixed contacts and the second positive fixed contact 22 of the second group 13 of fixed contacts are made common to form a common positive fixed contact 39.

Concurrently, first and second movable contacts 40, 41 are also arranged in a row. Hence, the arrangement provided is such that contact portions 40*a*, 40*b* of the first movable contact 40 are adapted to slide and are moved into contact with or away from the fixed contacts 15, 17, 39 of the first group 12 of fixed contacts 12, while contact portions 41*a*, 41*b* of the second movable contact 41 are adapted to slide and are moved into contact with or away from the fixed contacts 21, 23, 39 of the second group 13 of fixed contacts.

In this case, the first insulation portion 29, the first receiving portions 30, and the first recessed portions 31 are disposed in the area of the first negative fixed contact 17. Meanwhile, the second insulation portion 32, the second receiving portions 33, and the second recessed portions 34 are disposed in the area of the second negative fixed contact 23.

Figure 19:
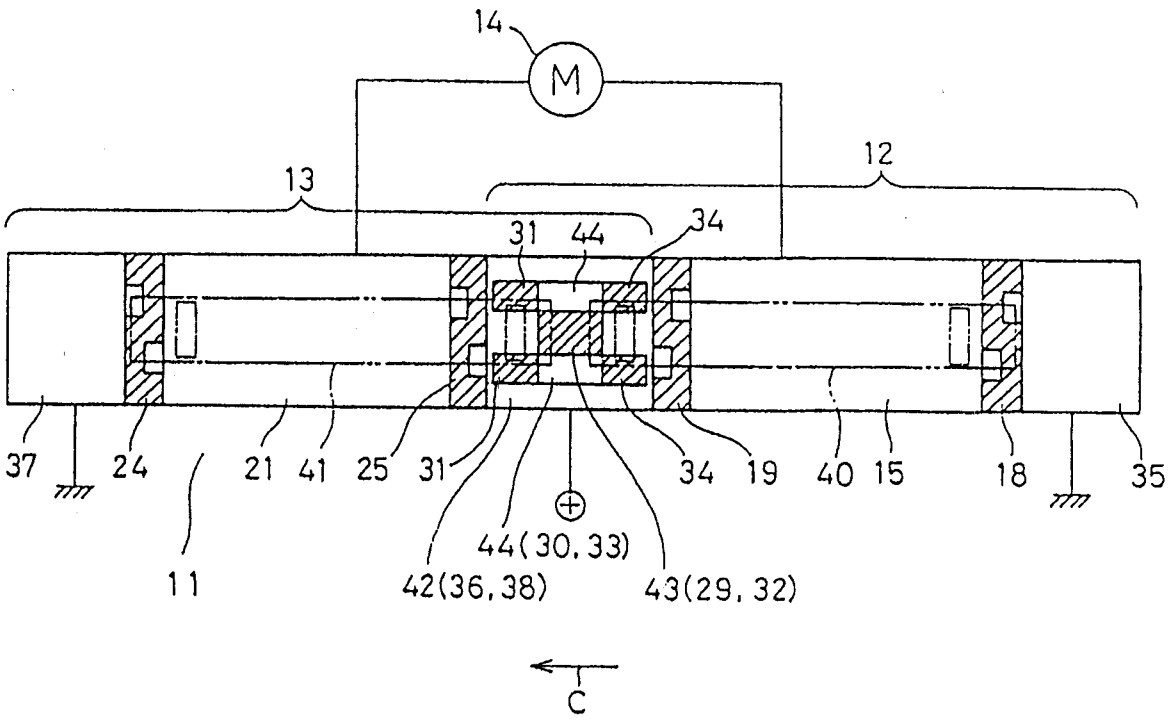
FIG. 19 is a diagram, similar to FIG. 1, of a sixth embodiment of the present invention.
Figure 20:
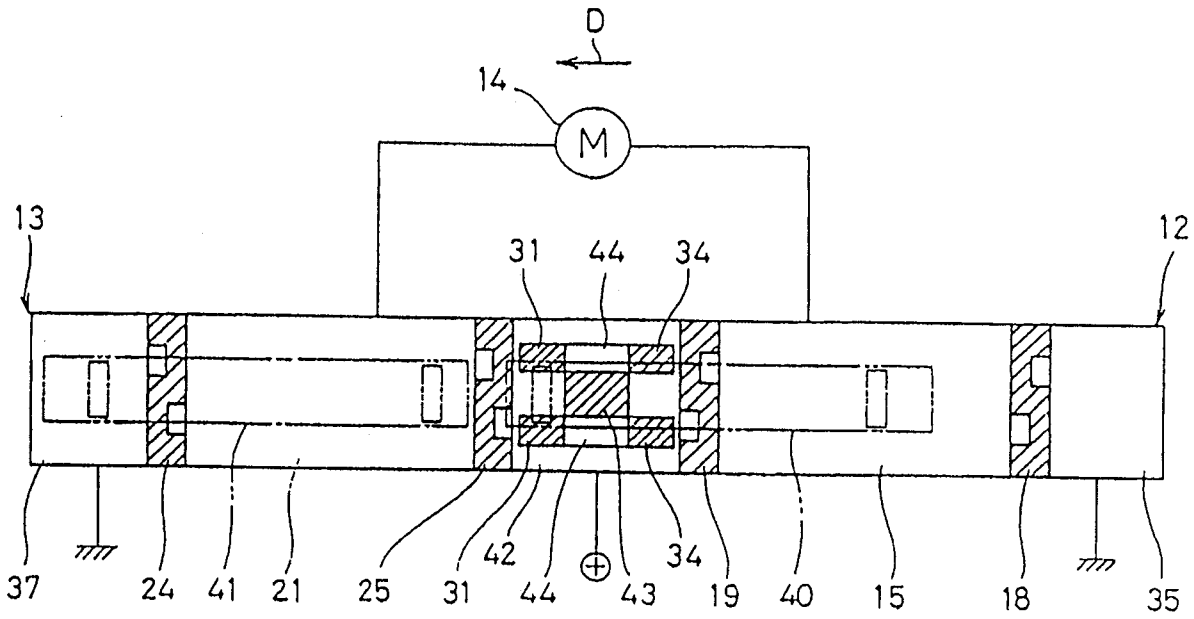
FIG. 20 is a diagram, similar to FIG. 4, of the sixth embodiment of the present invention.
Figure 21:
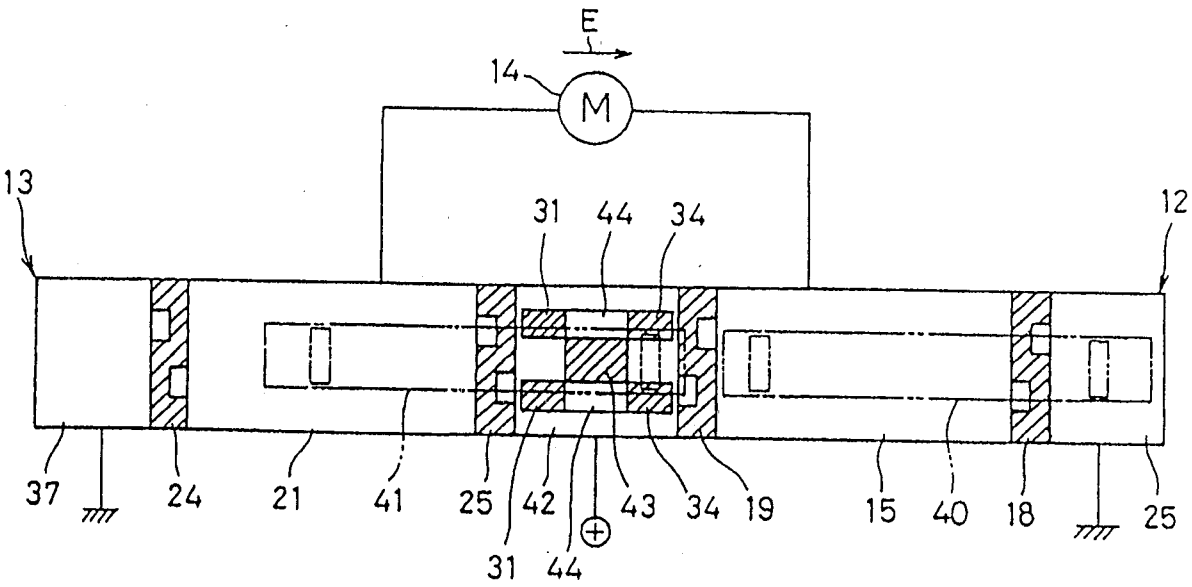
FIG. 21 is a diagram, similar to FIG. 5, of the sixth embodiment of the present invention.

FIGS. 19 to 21 show a sixth embodiment of the present invention, which differs from the second and fifth embodiments in the following aspects.

Namely, in this sixth embodiment, the first group 12 of fixed contacts and the second group 13 of fixed contacts in the second embodiment are arranged in a row (in the illustrated case, the first group 12 of fixed contacts is located on the right-hand side, and the second group 13 of fixed contacts on the left-hand side). In addition, the first positive fixed contact 36 of the first group 12 of fixed contacts and the second positive fixed contact 38 of the second group 13 of fixed contacts are made common to form a common positive fixed contact 42.

In addition, the following are disposed in the area of the common positive fixed contact 42: a common insulation portion 43 in which the first and second insulation portions 29, 32 are made common, a pair of common receiving portions 44 in each of which the first and second receiving portions 30, 33 are made common, and the first and second recessed portions 31, 34.

Figure 22:
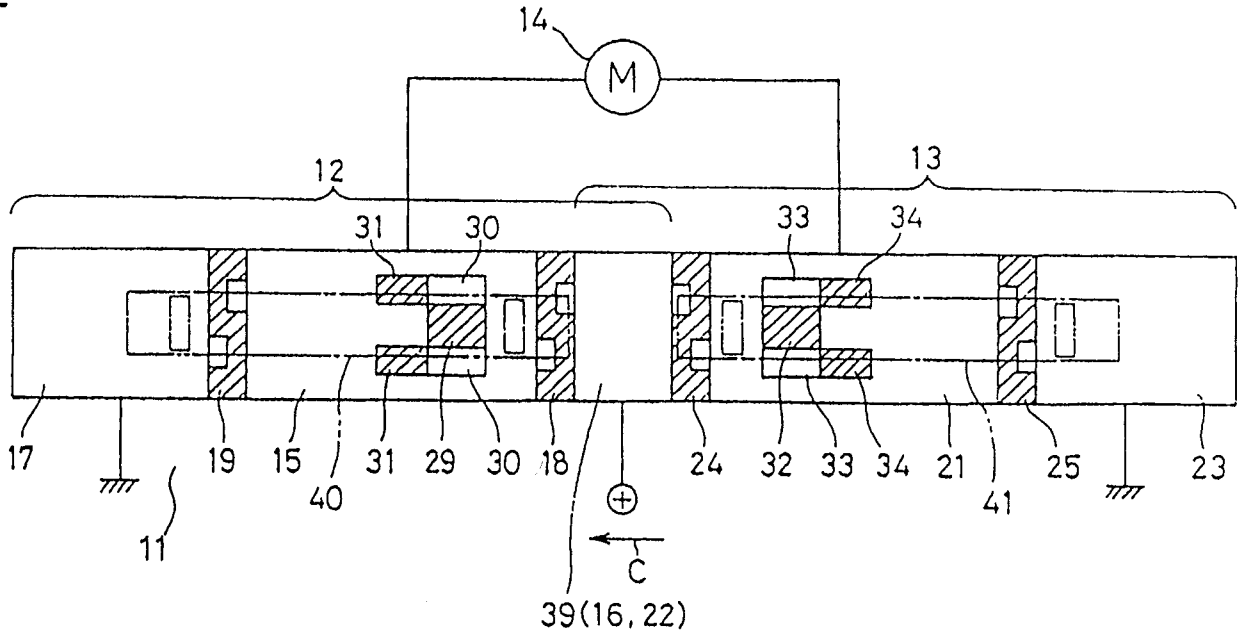
FIG. 22 is a diagram, similar to FIG. 1, of a seventh embodiment of the present invention.
Figure 23:
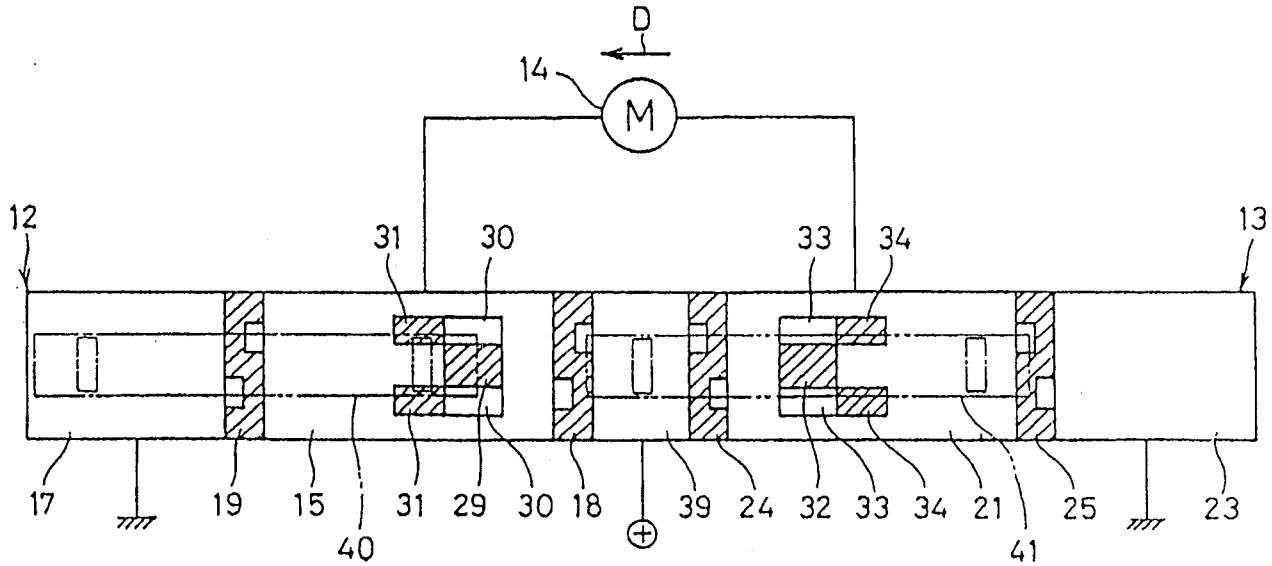
FIG. 23 is a diagram, similar to FIG. 4, of the seventh embodiment of the present invention.
Figure 24:
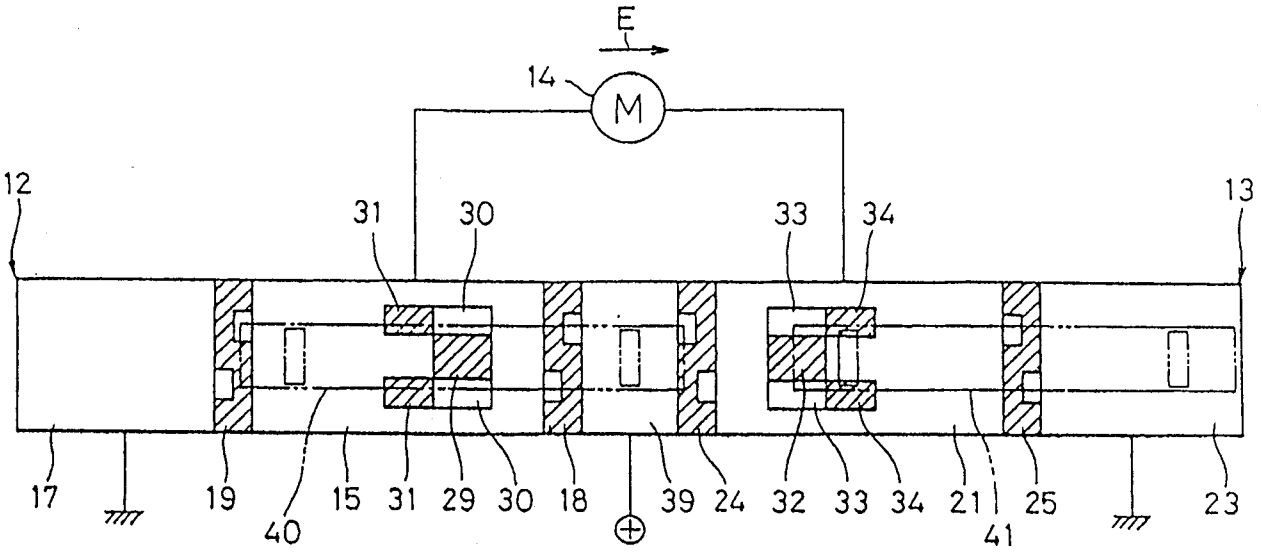
FIG. 24 is a diagram, similar to FIG. 5, of the seventh embodiment of the present invention.

FIGS. 22 to 24 show a seventh embodiment of the present invention, which differs from the fifth embodiment FIGS. 15 to 18) in the following aspects.

Namely, in this seventh embodiment, the relationship of arrangement of the first and second groups 12, 13 of fixed contacts is identical to that of the fifth embodiment. However, the arrangement differs from the fifth embodiment in that the first insulation portion 29, the first receiving portions 30, and the first recessed portions 31 are disposed in the area of the first common fixed contact 15, and in that the second insulation portion 32, the second receiving portions 33, and the second recessed portions 34 are disposed in the area of the second common fixed contact 21.

Figure 25:
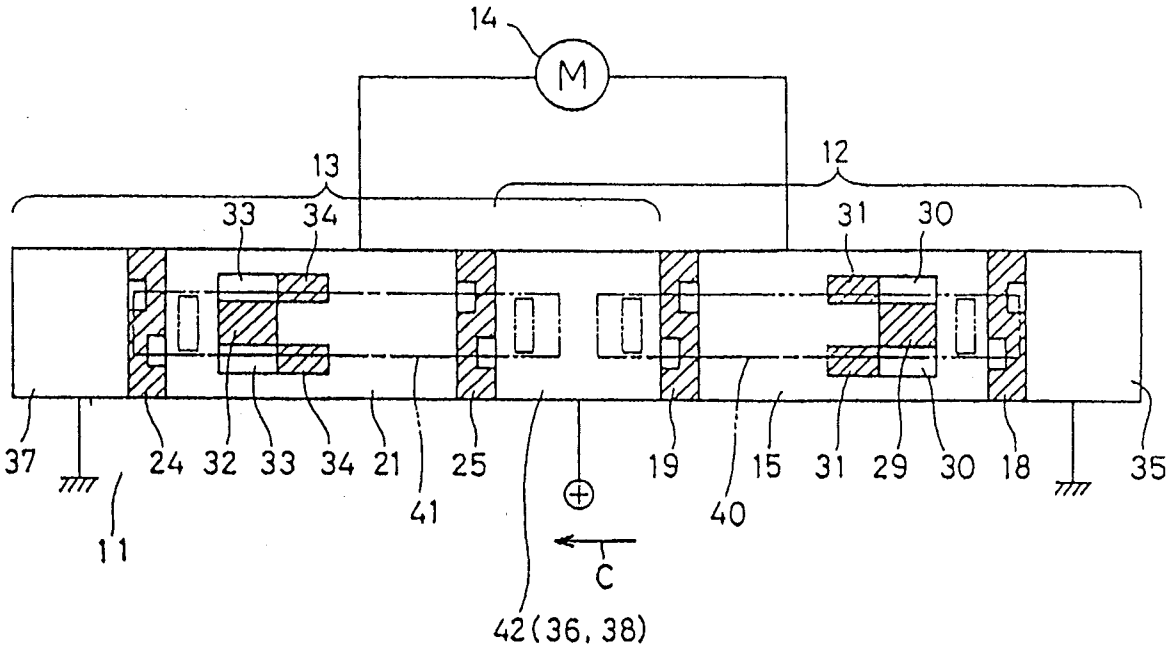
FIG. 25 is a diagram, similar to FIG. 1, of an eighth embodiment of the present invention.
Figure 26:
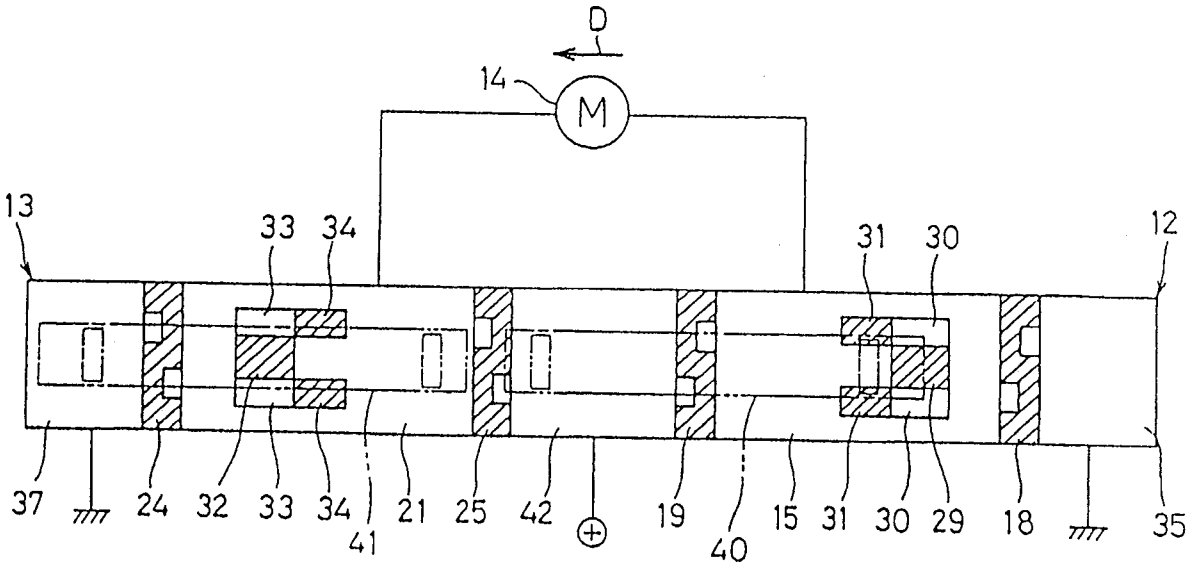
FIG. 26 is a diagram, similar to FIG. 4, of the eighth embodiment of the present invention.
Figure 27:
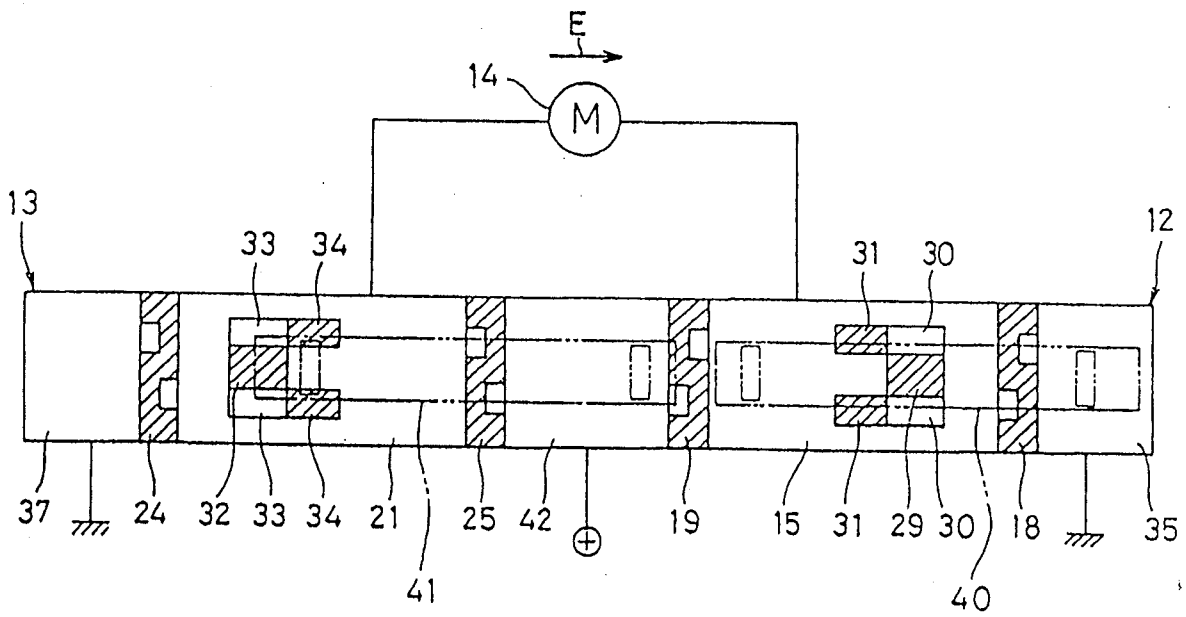
FIG. 27 is a diagram, similar to FIG. 5, of the eighth embodiment of the present invention.

FIGS. 25 to 27 show an eighth embodiment of the present invention, which differs from the sixth embodiment (FIGS. 19 to 21) in the following aspects.

Namely, in this eighth embodiment, the relationship of arrangement of the first and second groups 12, 13 of fixed contacts is identical to that of the sixth embodiment. However, the arrangement differs from the sixth embodiment in that the first insulation portion 29, the first receiving portions 30, and the first recessed portions 31 are disposed in the area of the first common fixed contact 15, and in that the second insulation portion 32, the second receiving portions 33, and the second recessed portions 34 are disposed in the area of the second common fixed contact 21.

Figure 28:
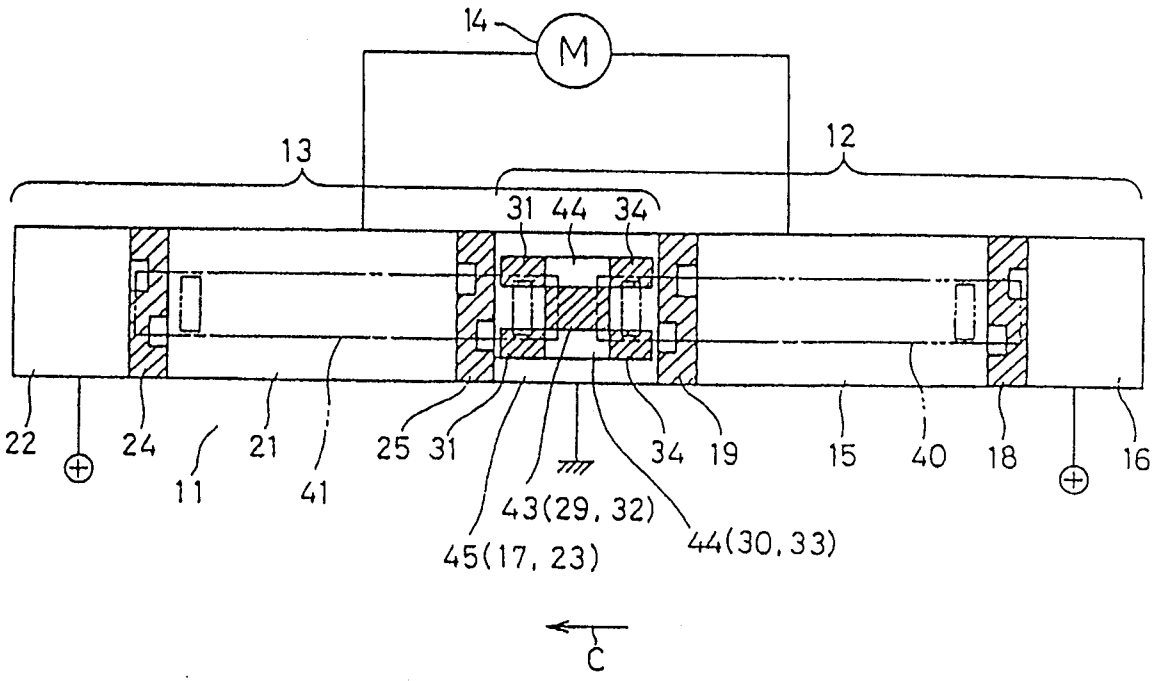
FIG. 28 is a diagram, similar to FIG. 1, of an ninth embodiment of the present invention.
Figure 29:
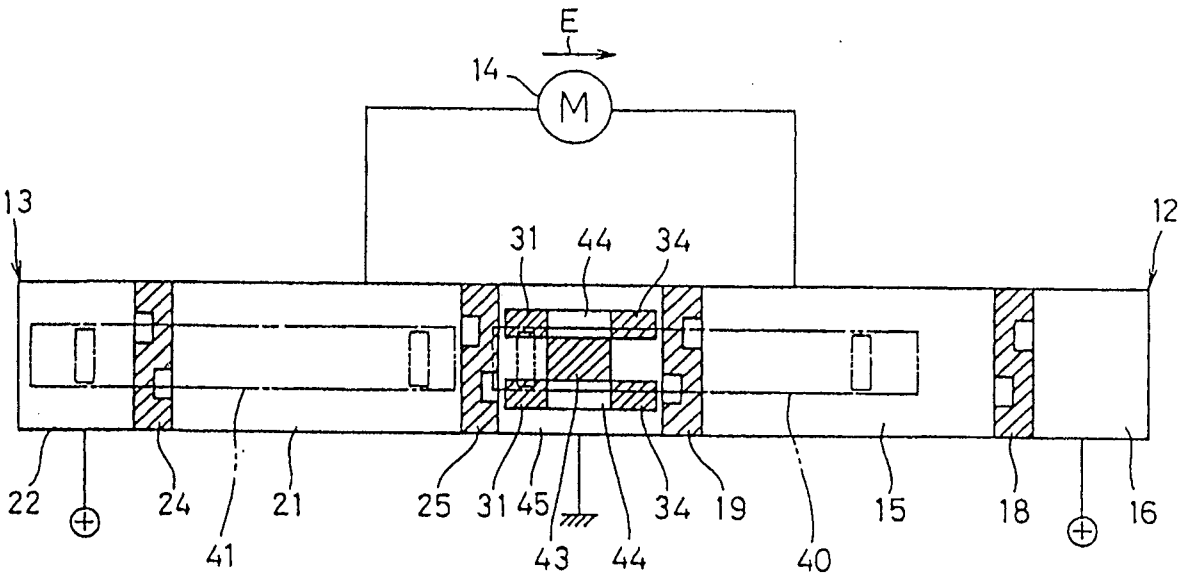
FIG. 29 is a diagram, similar to FIG. 4, of the ninth embodiment of the present invention.
Figure 30:
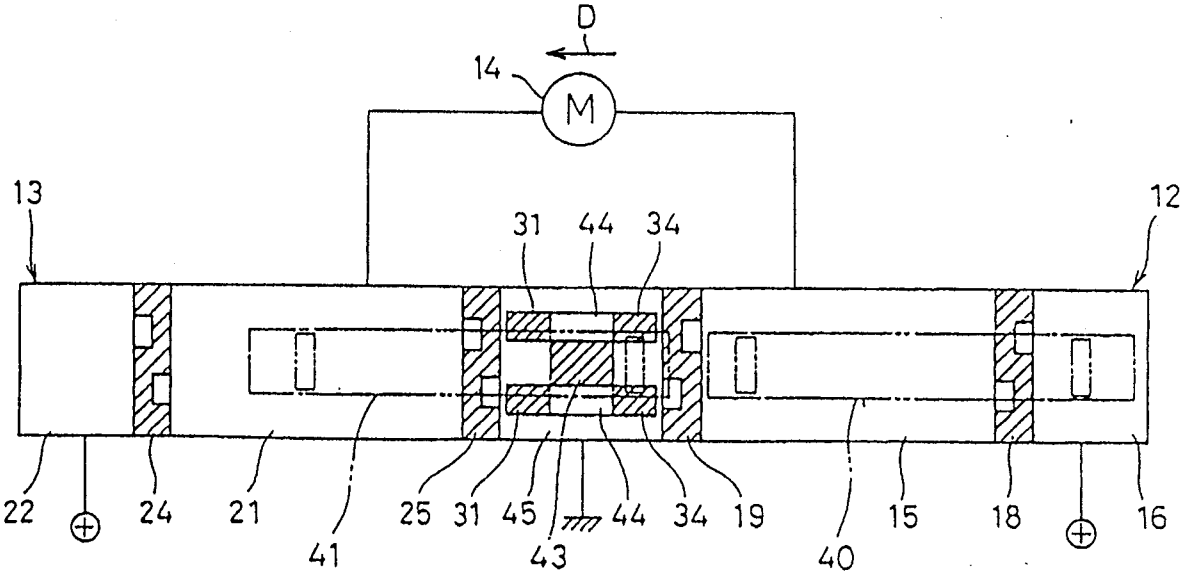
FIG. 30 is a diagram, similar to FIG. 5, of the ninth embodiment of the present invention.

FIGS. 28 to 30 show a ninth embodiment of the present invention, which differs from the first and fifth embodiments in the following aspects.

Namely, in this ninth embodiment, the first group 12 of fixed contacts and the second group 13 of fixed contacts in the first embodiment are arranged in a row (in the illustrated case, the first group 12 of fixed contacts is located on the right-hand side, and the second group 13 of fixed contacts on the left-hand side). In addition, the first negative fixed contact 17 of the first group 12 of fixed contacts and the second negative fixed contact 23 of the second group 13 of fixed contacts are made common to form a common negative fixed contact 45.

In addition, the following are disposed in the area of the common negative fixed contact 45: the common insulation portion 43 in which the first and second insulation portions 29, 32 are made common, the pair of common receiving portions 44 in each of which the first and second receiving portions 30, 33 are made common, and the first and second recessed portions 31, 34.

Figure 31:
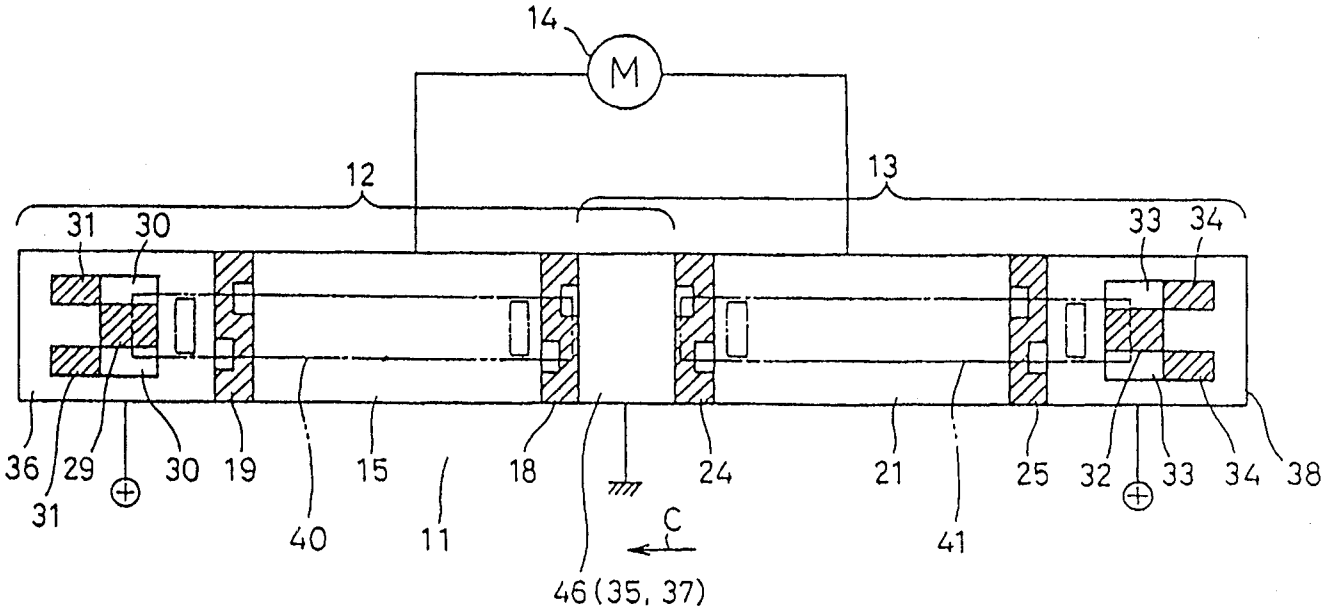
FIG. 31 is a diagram, similar to FIG. 1, of a 10th embodiment of the present invention.
Figure 32:
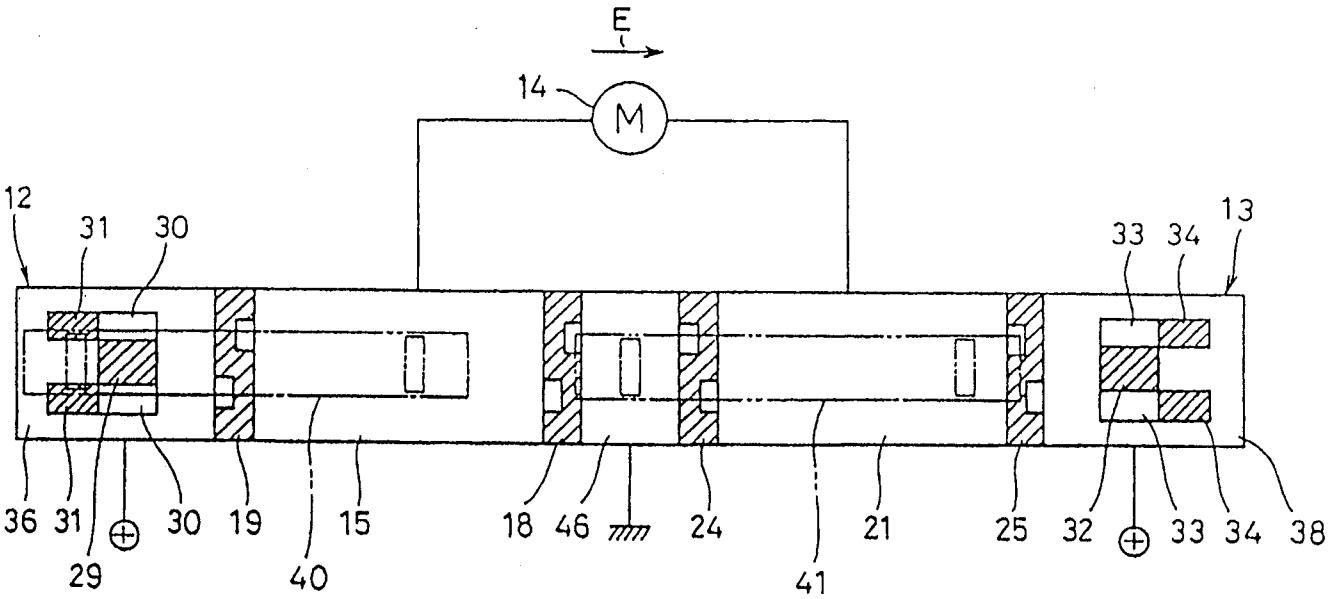
FIG. 32 is a diagram, similar to FIG. 4, of the 10th embodiment of the present invention.
Figure 33:
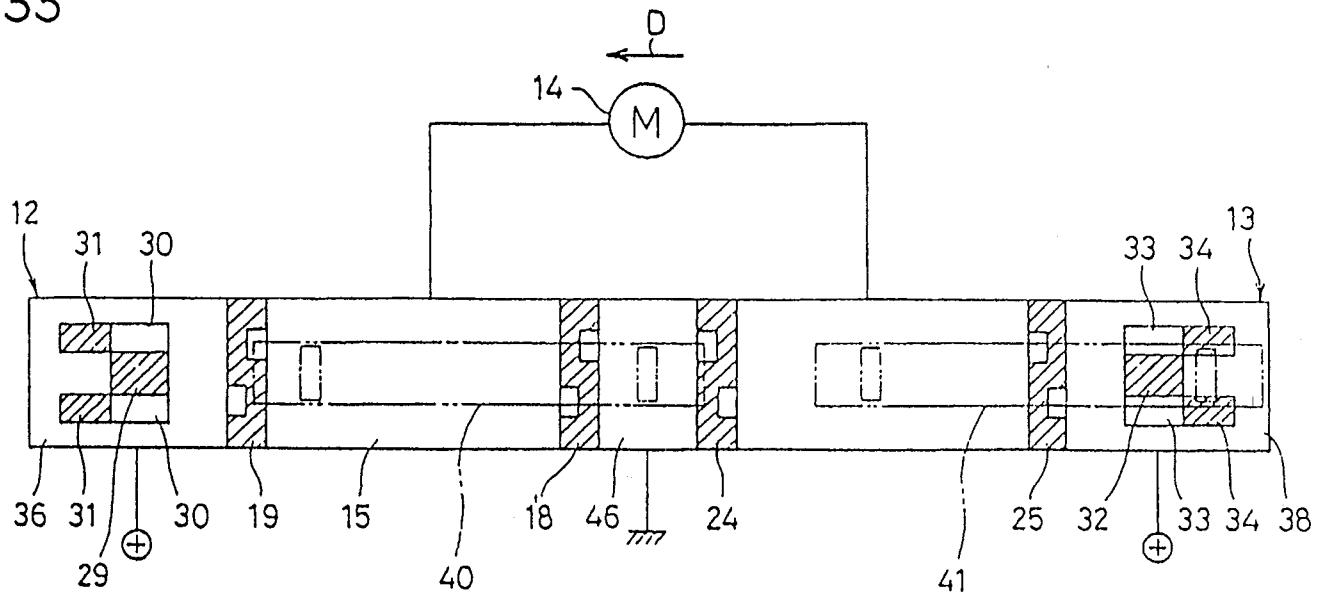
FIG. 33 is a diagram, similar to FIG. 5, of the 10th embodiment of the present invention.

FIGS. 31 to 33 show a 10th embodiment of the present invention, which differs from the second and ninth embodiments in the following aspects.

Namely, in this 10th embodiment, the first group 12 of fixed contacts and the second group 13 of fixed contacts in the second embodiment are arranged in a row (in the illustrated case, the first group 12 of fixed contacts is located on the left-hand side, and the second group 13 of fixed contacts on the right-hand side). In addition, the first negative fixed contact 35 of the first group 12 of fixed contacts and the second negative fixed contact 37 of the second group 13 of fixed contacts are made common to form a common negative fixed contact 46.

In this case, the first insulation portion 29, the first receiving portions 30, and the first recessed portions 31 are disposed in the area of the first positive fixed contact 36. Meanwhile, the second insulation portion 32, the second receiving portions 33, and the second recessed portions 34 are disposed in the area of the second positive fixed contact 38.

Figure 34:
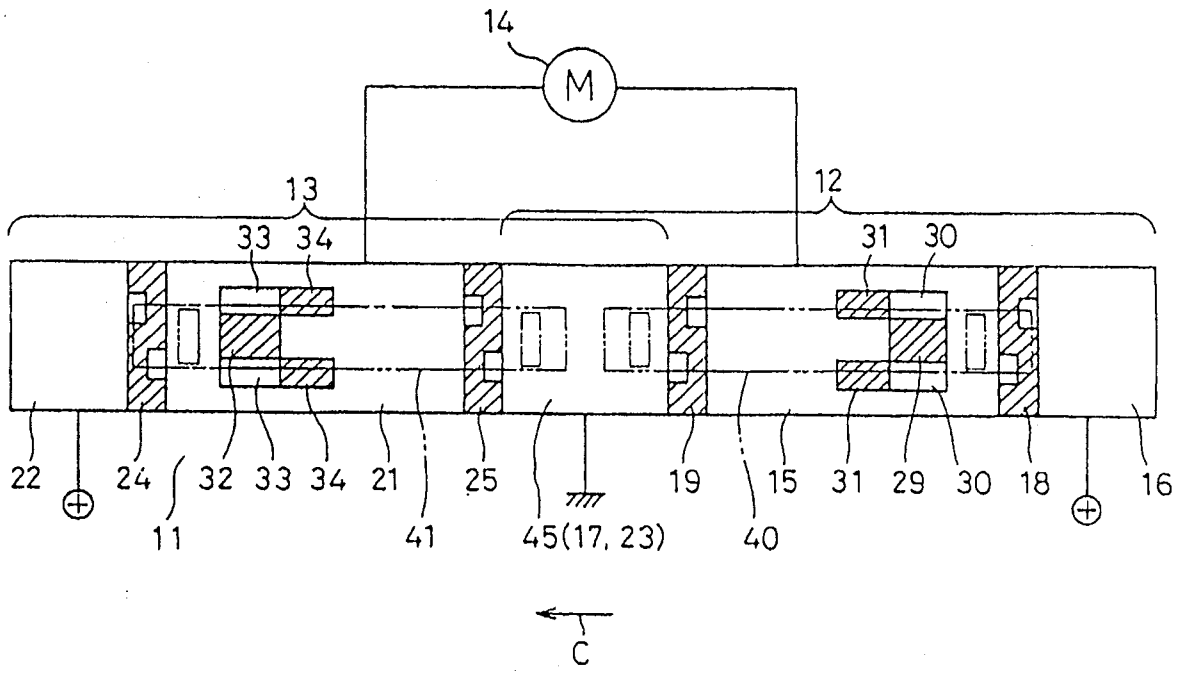
FIG. 34 is a diagram, similar to FIG. 1, of an 11th embodiment of the present invention.
Figure 35:
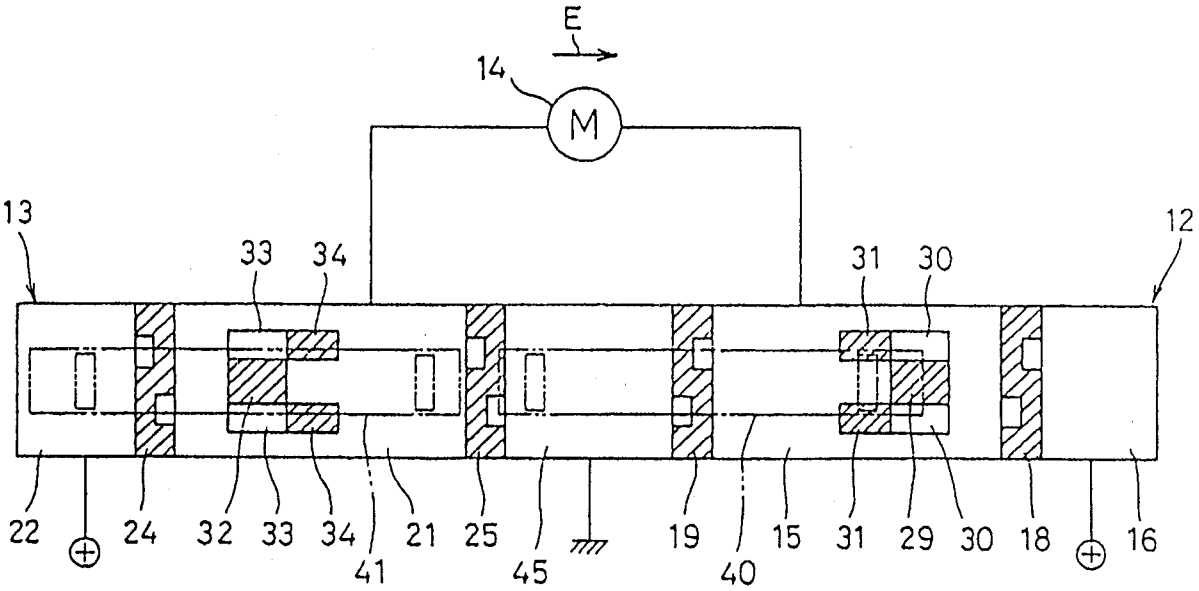
FIG. 35 is a diagram, similar to FIG. 4, of the 11th embodiment of the present invention.
Figure 36:
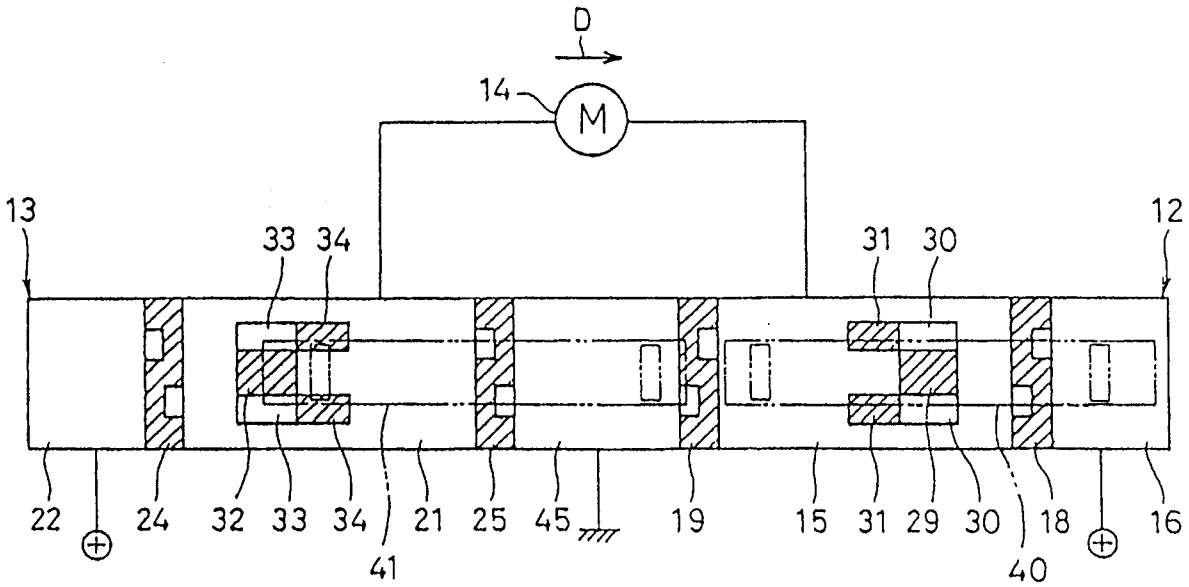
FIG. 36 is a diagram, similar to FIG. 5, of the 11th embodiment of the present invention.

FIGS. 34 to 36 show an 11th embodiment of the present invention, which differs from the ninth embodiment (FIGS. 28 to 30) in the following aspects.

Namely, in this 11th embodiment, the relationship of arrangement of the first and second groups 12, 13 of fixed contacts is identical to that of the ninth embodiment. However, the arrangement differs from the ninth embodiment in that the first insulation portion 29, the first receiving portions 30, and the first recessed portions 31 are disposed in the area of the first common fixed contact 15, and in that the second insulation portion 32, the second receiving portions 33, and the second recessed portions 34 are disposed in the area of the second common fixed contact 21.

Figure 37:
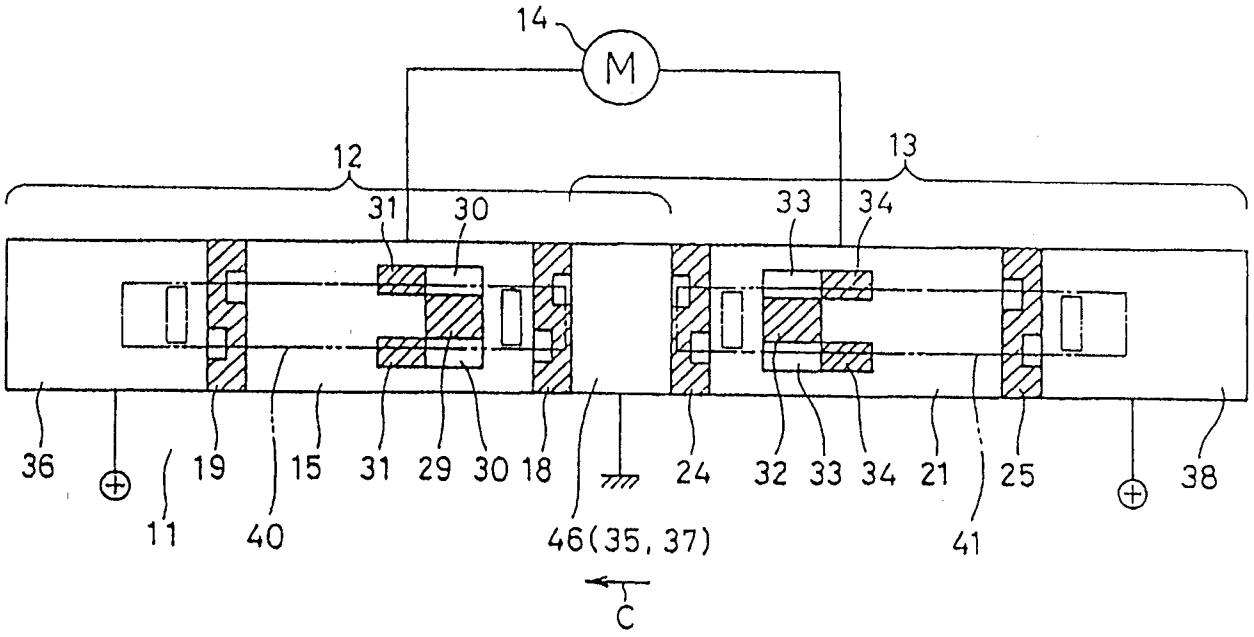
FIG. 37 is a diagram, similar to FIG. 1, of a 12th embodiment of the present invention.
Figure 38:
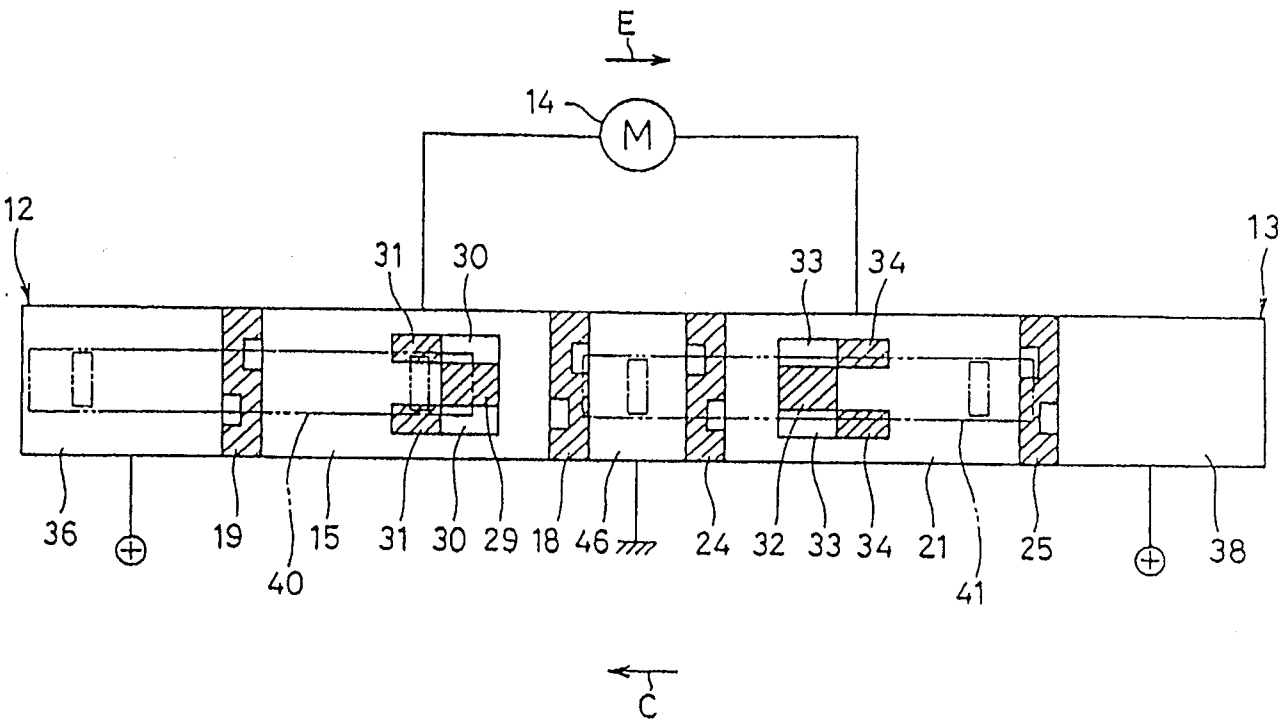
FIG. 38 is a diagram, similar to FIG. 4, of the 12th embodiment of the present invention.
Figure 39:
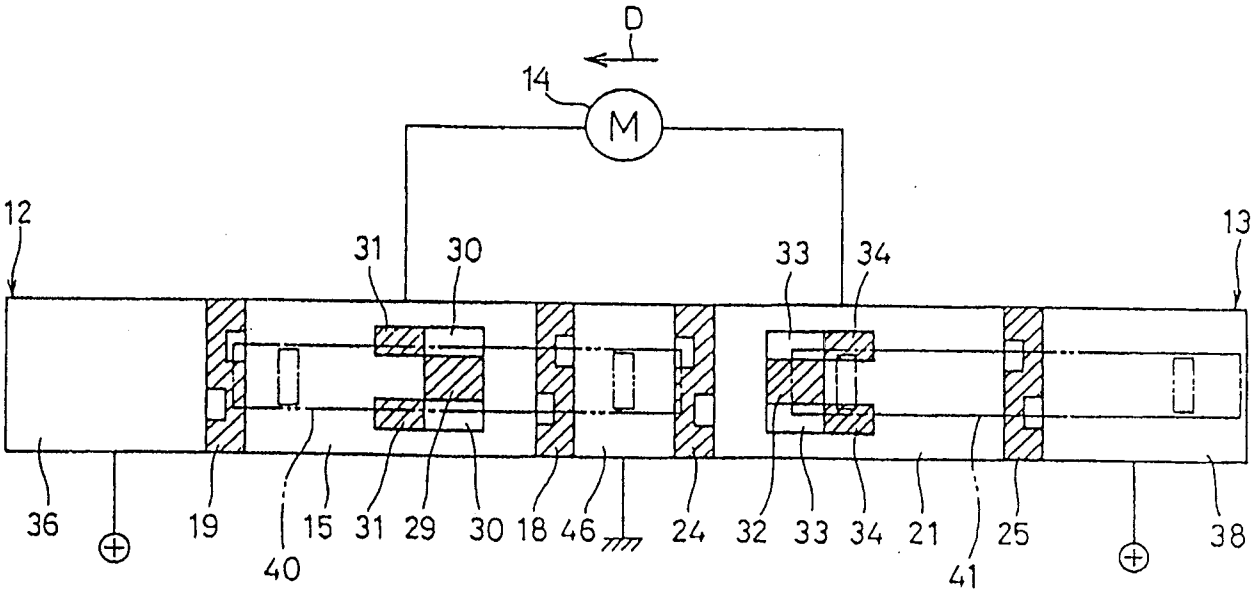
FIG. 39 is a diagram, similar to FIG. 5, of the 12th embodiment of the present invention.
Figure 40:
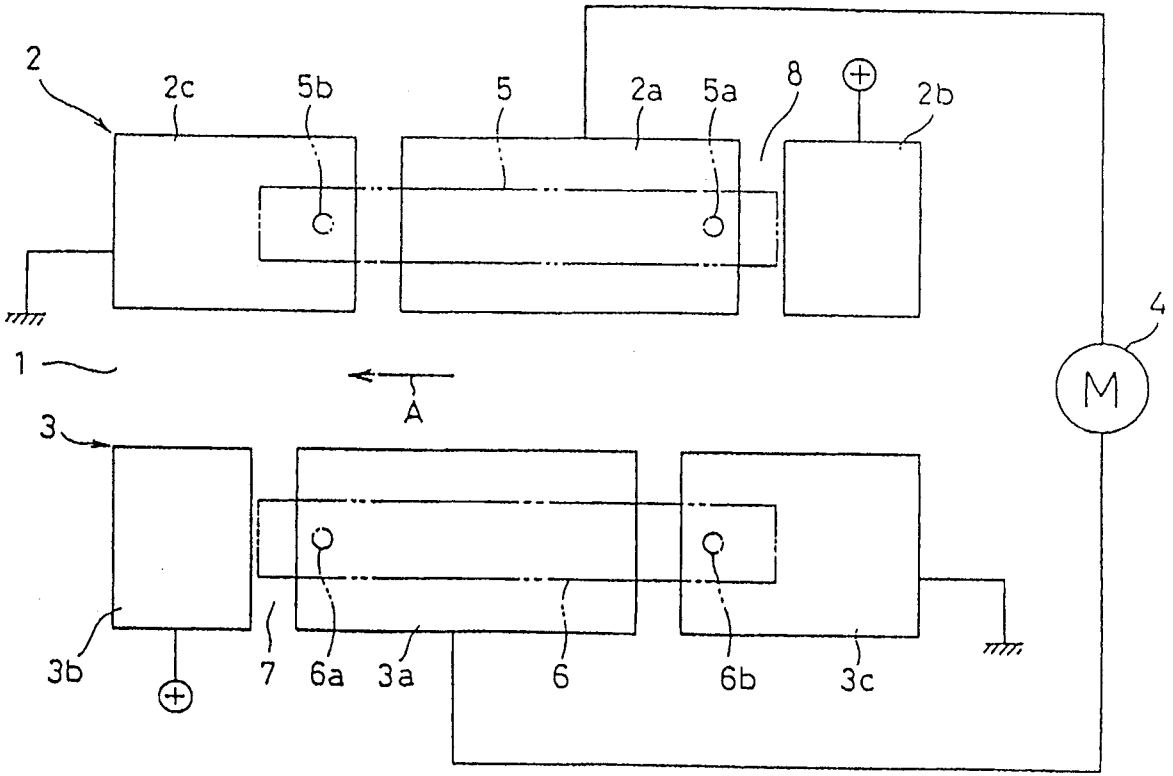
FIG. 40 PRIOR ART
FIG. 40 is a diagram, similar to FIG. 1, of a conventional arrangement.
Figure 41:
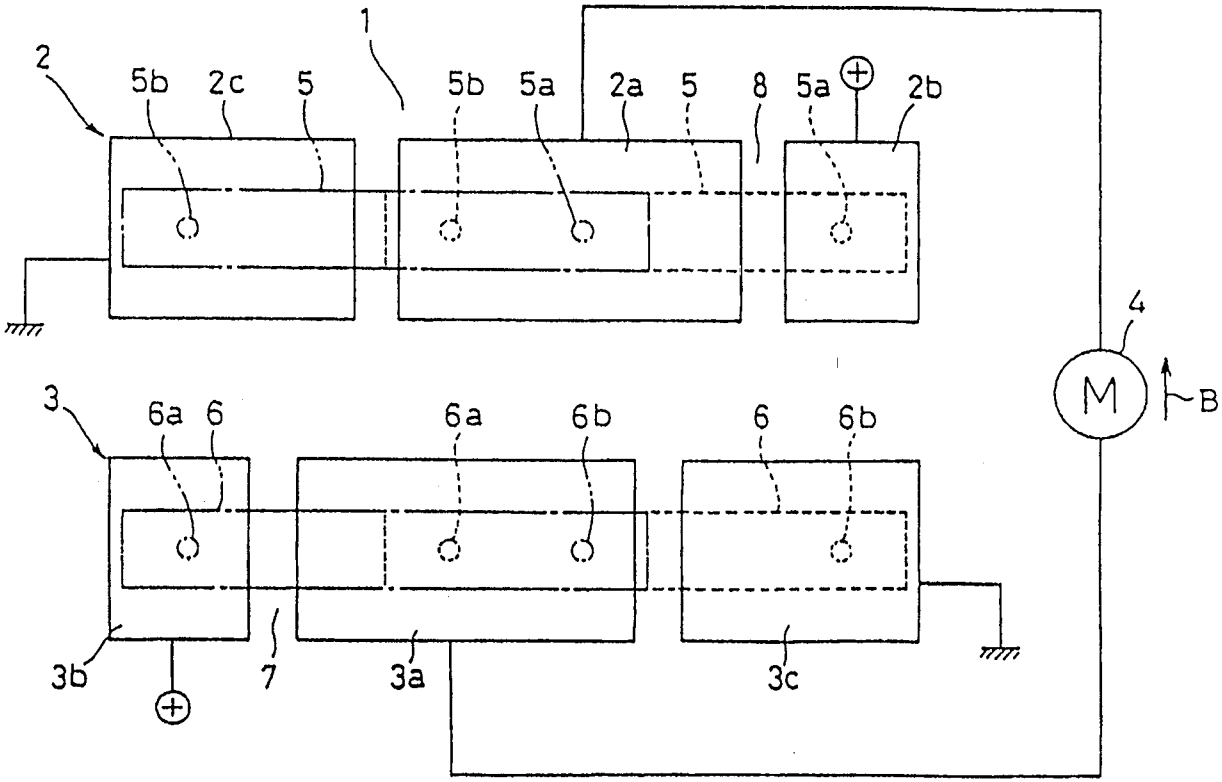
FIG. 41 PRIOR ART
FIG. 41 is a diagram similar to FIG. 40 but showing a state in which the first and second movable contacts have moved to the first and second operating positions.

FIGS. 37 to 39 show a 12th embodiment of the present invention, which differs from the 10th embodiment (FIGS. 31 to 33) in the following aspects.

Namely, in this 12th embodiment, the relationship of arrangement of the first and second groups 12, 13 of fixed contacts is identical to that of the 10th embodiment. However, the arrangement differs from the 10th embodiment in that the first insulation portion 29, the first receiving portions 30, and the first recessed portions 31 are disposed in the area of the first common fixed contact 15, and in that the second insulation portion 32, the second receiving portions 33, and the second recessed portions 34 are disposed in the area of the second common fixed contact 21.

The fifth to 12th embodiments exhibit action and effect similar to those of the first embodiment, and additionally offer the following advantages.

Namely, since the first and second groups 12, 13 of fixed contacts are arranged in a row, there is an advantage in that a space in a direction perpendicular to the moving direction of the first and second movable contacts 40, 41 can be reduced as compared with the case where they are arranged in parallel.

In addition, since the first positive fixed contacts 16, 36 of the first group 12 of fixed contacts and the second positive fixed contacts 22, 38 of the second group 13 of fixed contacts are made common, or the first negative fixed contacts 17, 35 of the first group 12 of fixed contacts and the second negative fixed contacts 23, 37 of the second group 13 of fixed contacts are made common, there is an advantage in that a space in the moving direction of the first and second movable contacts 40, 41 can be reduced as compared with the case where the first group 12 of fixed contacts and the second group 13 of fixed contacts are arranged simply in a row.

It should be noted that the present invention is not limited to the switch for the window regulator and can be similarly applied to other tandem sliding switches.

What is claimed is:

1. A sliding switch comprising:

a first group of fixed contacts having a first common fixed contact, a first positive fixed contact, and a first negative fixed contact;

a second group of fixed contacts having a second common fixed contact connected to said first common fixed contact via a load, a second positive fixed contact, and a second negative fixed contact;

a first movable contact disposed so as to slide between a first operating position and a second operating position with a neutral position placed therebetween and to slide on said first group of fixed contacts as said first movable contact slides, said first movable contact being adapted to contact said first common fixed contact and one of said first positive and negative fixed contacts in the neutral position and the first operating position and to contact said first common fixed contact and the other one of said first positive and negative fixed contacts in the second operating position;

a second movable contact disposed so as to slide between the first operating position and the second operating position with the neutral position placed therebetween in synchronism with said first movable contact and to slide on said second group of fixed contacts as said second movable contact slides, said second movable contact being adapted to contact said second common fixed contact and one of said second positive and negative fixed contacts in the neutral position and the second operating position and to contact said second common fixed contact and the other one of said second positive and negative fixed contacts in the first operating position;

a first insulation portion disposed in one of said first positive and negative fixed contacts so as to temporarily move said first movable contact away from said one of said first positive and negative fixed contacts before said second movable contact moves away from one of said fixed contacts of said second group of fixed contacts when said first and second movable contacts slide from the first operating position to the neutral position; and a second insulation portion disposed in one of said second positive and negative fixed contacts so as to temporarily move said second movable contact away from said one of said second positive and negative fixed contacts before said first movable contact moves away from one of said fixed contacts of said first group of fixed contacts when said first and second movable contacts slide from the second operating position to the neutral position.

2. A sliding switch according to claim 1, wherein said first group of fixed contacts and said second group of fixed contacts are each aligned with an axis, said axes being colinear, and said first positive fixed contact of said first group of fixed contacts and said second positive fixed contact of said second group of fixed contacts are made common to form one unified positive contact.

3. A sliding switch according to claim 1, wherein said first group of fixed contacts and said second group of fixed contacts are each aligned with an axis, said axes being colinear, and said first negative fixed contact of said first group of fixed contacts and said second negative fixed contact of said second group of fixed contacts are made common to form one unified negative contact.

4. A sliding switch according to claim 1, wherein said first and second insulation portions are recessed, and said first and second movable contacts are elongated.

5. A sliding switch according to claim 4, further comprising:

a pair of first receiving portions disposed on opposite sides of said first insulation portion arranged in a direction perpendicular to a moving direction of said first movable contact, such that opposite ends of said first movable contact slide on said pair of first receiving portions;

a pair of first recessed portions respectively continuing from said pair of first receiving portions and disposed at positions located along the moving direction of said first movable contact;

a pair of second receiving portions disposed on opposite sides of said second insulation portion arranged in a direction perpendicular to a moving direction of said second movable contact, such that opposite ends of said second movable contact slide on said pair of second receiving portions; and a pair of second recessed portions respectively continuing from said pair of second receiving portions and disposed at positions located along the moving direction of said second movable contact.

6. A sliding switch according to claim 1, wherein said first and second insulation portions are formed by holes through said first fixed contact and said second fixed contact, respectively, defining an insulative air space.

7. The sliding switch of claim 1, further comprising insulation space portions disposed between said first common fixed contact and said first positive fixed contact and between said first common fixed contact and said first negative fixed contact.

8. The sliding switch of claim 1, further comprising insulation space portions disposed between said second common fixed contact and said second positive fixed contact and between said second common fixed contact and said second negative fixed contact.

9. A sliding switch comprising:

a first group of fixed contacts having a first common fixed contact, a first positive fixed contact, and a first negative fixed contact;

a second group of fixed contacts having a second common fixed contact connected to said first common fixed contact via a load, a second positive fixed contact, and a second negative fixed contact;

a first movable contact disposed so as to slide between a first operating position and a second operating position with a neutral position placed therebetween and to slide on said first group of fixed contacts as said first movable contact slides, said first movable contact being adapted to contact said first common fixed contact and one of said first positive and negative fixed contacts in the neutral position and the first operating position and to contact said first common fixed contact and the other one of said first positive and negative fixed contacts in the second operating position;

a second movable contact disposed so as to slide between the first operating position and the second operating position with the neutral position placed therebetween in synchronism with said first movable contact and to slide on said second group of fixed contacts as said second movable contact slides, said second movable contact being adapted to contact said second common fixed contact and one of said second positive and negative fixed contacts in the neutral position and the second operating position and to contact said second common fixed contact and the other one of said second positive and negative fixed contacts in the first operating position;

a first insulation portion disposed in one of said first positive and negative fixed contacts so as to temporarily move said first movable contact away from said one of said first positive and negative fixed contacts after said first movable contact has contacted said one of said positive and negative fixed contacts of said first group of fixed contacts and so as to cause said first movable contact to contact again said one of said first positive and negative fixed contacts after said second movable contact has contacted one of said second positive and negative fixed contacts of an opposite polarity as said one of said first positive and negative fixed contacts, when said first and second movable contacts slide from the neutral position to the first operating position; and a second insulation portion disposed in one of said second positive and negative fixed contacts so as to temporarily move said second movable contact away from said one of said second positive and negative fixed contacts after said second movable contact has contacted said one of said positive and negative fixed contacts of said second group of fixed contacts and so as to cause said second movable contact to contact again said one of said second positive and negative fixed contacts after said first movable contact has contacted one of said first positive and negative fixed contacts of an opposite polarity as said one of said second positive and negative fixed contacts, when said first and second movable contacts slide from the neutral position to the second operating position.

10. A sliding switch according to claim 9, wherein said first group of fixed contacts and said second group of fixed contacts are each aligned along an axis, said axes being colinear, and said first positive fixed contact of said first group of fixed contacts and said second positive fixed contact of said second group of fixed contacts are made common to form one unified positive contact.

11. A sliding switch according to claim 9, wherein said first group of fixed contacts and said second group of fixed contacts are each aligned along an axis, said axes being colinear, and said first negative fixed contact of said first group of fixed contacts and said second negative fixed contact of said second group of fixed contacts are made common to form one unified negative contact.

12. A sliding switch according to claim 9, wherein said first and second insulation portions are recessed, and said first and second movable contacts are elongated.

13. A sliding switch according to claim 12, further comprising:

a pair of first receiving portions disposed on opposite sides of said first insulation portion arranged in a direction perpendicular to a moving direction of said first movable contact, such that opposite ends of said first movable contact slide on said pair of first receiving portions;

a pair of first recessed portions respectively continuing from said pair of first receiving portions and disposed at positions located along the moving direction of said first movable contact;

a pair of second receiving portions disposed on opposite sides of said second insulation portion arranged in a direction perpendicular to a moving direction of said second movable contact, such that opposite ends of said second movable contact slide on said pair of second receiving portions; and a pair of second recessed portions respectively continuing from said pair of second receiving portions and disposed at positions located along the moving direction of said second movable contact.

14. A sliding switch according to claim 9, wherein said first and second insulation portions are formed by holes through said first fixed contact and said second fixed contact, respectively, defining an insulative air space.

15. The sliding switch of claim 9, further comprising insulation space portions disposed between said first common fixed contact and said first positive fixed contact and between said first common fixed contact and said first negative fixed contact.

16. The sliding switch of claim 9, further comprising insulation space portions disposed between said second common fixed contact and said second positive fixed contact and between said second common fixed contact and said second negative fixed contact.

17. A sliding switch comprising:

a first group of fixed contacts having a first common fixed contact, a first positive fixed contact, and a first negative fixed contact;

a second group of fixed contacts having a second common fixed contact connected to said first common fixed contact via a load, a second positive fixed contact, and a second negative fixed contact;

a first movable contact disposed so as to slide between a first operating position and a second operating position with a neutral position placed therebetween and to slide on said first group of fixed contacts as said first movable contact slides, said first movable contact being adapted to contact said first common fixed contact and one of said first positive and negative fixed contacts in the neutral position and the first operating position and to contact said first common fixed contact and the other one of said first positive and negative fixed contacts in the second operating position;

a second movable contact disposed so as to slide between the first operating position and the second operating position with the neutral position placed therebetween in synchronism with said first movable contact and to slide on said second group of fixed contacts as said second movable contact slides, said second movable contact being adapted to contact said second common fixed contact and one of said second positive and negative fixed contacts in the neutral position and the second operating position and to contact said second common fixed contact and the other one of said second positive and negative fixed contacts in the first operating position;

a first insulation portion disposed in said first common fixed contact so as to temporarily move said first movable contact away from said first common fixed contact before said second movable contact moves away from one of said fixed contacts of said second group of fixed contacts when said first and second movable contacts slide from the first operating position to the neutral position; and a second insulation portion disposed in said second common fixed contact so as to temporarily move said second movable contact away from said second common fixed contact before said first movable contact moves away from one of said fixed contacts of said first group of fixed contacts when said first and second movable contacts slide from the second operating position to the neutral position.

18. A sliding switch according to claim 17, wherein said first group of fixed contacts and said second group of fixed contacts are each aligned along an axis, said axes being colinear, and said first positive fixed contact of said first group of fixed contacts and said second positive fixed contact of said second group of fixed contacts are made common to form one unified positive contact.

19. A sliding switch according to claim 17, wherein said first group of fixed contacts and said second group of fixed contacts are each aligned along an axis, said axes being colinear, and said first negative fixed contact of said first group of fixed contacts and said second negative fixed contact of said second group of fixed contacts are made common to form one unified negative contact.

20. A sliding switch according to claim 17, wherein said first and second insulation portions are recessed, and said first and second movable contacts are elongated.

21. A sliding switch according to claim 20, further comprising:

a pair of first receiving portions disposed on opposite sides of said first insulation portion arranged in a direction perpendicular to a moving direction of said first movable contact, such that opposite ends of said first movable contact slide on said pair of first receiving portions;

a pair of first recessed portions respectively continuing from said pair of first receiving portions and disposed at positions located along the moving direction of said first movable contact;

a pair of second receiving portions disposed on opposite sides of said second insulation portion arranged in a direction perpendicular to a moving direction of said second movable contact, such that opposite ends of said second movable contact slide on said pair of second receiving portions; and a pair of second recessed portions respectively continuing from said pair of second receiving portions and disposed at positions located along the moving direction of said second movable contact.

22. A sliding switch according to claim 17, wherein said first and second insulation portions are formed by holes through said first common fixed contact and said second common fixed contact, respectively, defining an insulative air space.

23. The sliding switch of claim 17, further comprising insulation space portions disposed between said first common fixed contact and said first positive fixed contact and between said first common fixed contact and said first negative fixed contact.

24. The sliding switch of claim 17, further comprising insulation space portions disposed between said second common fixed contact and said second positive fixed contact and between said second common fixed contact and said second negative fixed contact.

25. A sliding switch comprising:

a first group of fixed contacts having a first common fixed contact, a first positive fixed contact, and a first negative fixed contact;

a second group of fixed contacts having a second common fixed contact connected to said first common fixed contact via a load, a second positive fixed contact, and a second negative fixed contact;

a first movable contact disposed so as to slide between a first operating position and a second operating position with a neutral position placed therebetween and to slide on said first group of fixed contacts as said first movable contact slides, said first movable contact being adapted to contact said first common fixed contact and one of said first positive and negative fixed contacts in the neutral position and the first operating position and to contact said first common fixed contact and the other one of said first positive and negative fixed contacts in the second operating position;

a second movable contact disposed so as to slide between the first operating position and the second operating position with the neutral position placed therebetween in synchronism with said first movable contact and to slide on said second group of fixed contacts as said second movable contact slides, said second movable contact being adapted to contact said second common fixed contact and one of said second positive and negative fixed contacts in the neutral position and the second operating position and to contact said second common fixed contact and the other one of said second positive and negative fixed contacts in the first operating position;

a first insulation portion disposed in said first common fixed contact so as to temporarily move said first movable contact away from said first common fixed contact and so as to cause said first movable contact to contact again said first common fixed contact after said second movable contact has contacted one of said second positive and negative fixed contacts, when said first and second movable contacts slide from the neutral position to the first operating position; and a second insulation portion disposed in said second common fixed contact so as to temporarily move said second movable contact away from said second common fixed contact and so as to cause said second movable contact to contact again said second common fixed contact after said first movable contact has contacted one of said first positive and negative fixed contacts, when said first and second movable contacts slide from the neutral position to the second operating position.

26. A sliding switch according to claim 25, wherein said first group of fixed contacts and said second group of fixed contacts are each aligning along an axis, said axes being colinear, and said first positive fixed contact of said first group of fixed contacts and said second positive fixed contact of said second group of fixed contacts are made common to form one unified positive contact.

27. A sliding switch according to claim 25, wherein said first group of fixed contacts and said second group of fixed contacts are each aligned along an axis, said axes being colinear, and said first negative fixed contact of said first group of fixed contacts and said second negative fixed contact of said second group of fixed contacts are made common to form one unified negative contact.

28. A sliding switch according to claim 25, wherein said first and second insulation portions are recessed, and said first and second movable contacts are elongated.

29. A sliding switch according to claim 28, further comprising:

a pair of first receiving portions disposed on opposite sides of said first insulation portion arranged in a direction perpendicular to a moving direction of said first movable contact, such that opposite ends of said first movable contact slide on said pair of first receiving portions;

a pair of first recessed portions respectively continuing from said pair of first receiving portions and disposed at positions located along the moving direction of said first movable contact;

a pair of second receiving portions disposed on opposite sides of said second insulation portion arranged in a direction perpendicular to a moving direction of said second movable contact, such that opposite ends of said second movable contact slide on said pair of second receiving portions; and a pair of second recessed portions respectively continuing from said pair of second receiving portions and disposed at positions located along the moving direction of said second movable contact.

30. A sliding switch according to claim 25, wherein said first and second insulation portions are formed by holes through said first common fixed contact and said second common fixed contact, respectively, defining an insulative air space.

31. The sliding switch of claim 25, further comprising insulation space portions disposed between said first common fixed contact and said first positive fixed contact and between said first common fixed contact and said first negative fixed contact.

32. The sliding switch of claim 25, further comprising insulation space portions disposed between said second common fixed contact and said second positive fixed contact and between said second common fixed contact and said second negative fixed contact.

* * * * *